US007581807B2

(12) United States Patent
Hatasa et al.

(10) Patent No.: US 7,581,807 B2
(45) Date of Patent: Sep. 1, 2009

(54) LIQUID CONTAINER AND INK JET PRINTING APPARATUS

(75) Inventors: Nobuyuki Hatasa, Kawasaki (JP); Kenjiro Watanabe, Tokyo (JP); Kimiyuki Hayasaki, Yokohama (JP); Takayuki Ochiai, Tokyo (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 11/808,786

(22) Filed: Jun. 13, 2007

(65) Prior Publication Data

US 2008/0001985 A1 Jan. 3, 2008

(30) Foreign Application Priority Data

Jun. 30, 2006 (JP) ..... 2006-182428

(51) Int. Cl.
*B41J 29/393* (2006.01)

(52) U.S. Cl. ..... 347/19

(58) Field of Classification Search ..... 347/84, 347/85, 86, 19
See application file for complete search history.

(56) References Cited

U.S. PATENT DOCUMENTS

| | | | | |
|---|---|---|---|---|
| 6,431,681 | B2 | 8/2002 | Hatasa et al. | 347/19 |
| 6,609,788 | B2 | 8/2003 | Hatasa et al. | 347/86 |
| 6,652,053 | B2 * | 11/2003 | Imanaka et al. | 347/7 |
| 6,719,394 | B2 | 4/2004 | Kubota et al. | 347/19 |
| 6,935,716 | B2 | 8/2005 | Hatasa et al. | 347/19 |
| 7,059,699 | B2 * | 6/2006 | Asauchi et al. | 347/10 |
| 7,111,919 | B2 | 9/2006 | Hatasa et al. | 347/19 |
| 7,128,380 | B2 | 10/2006 | Hatasa et al. | 347/7 |
| 7,213,914 | B2 | 5/2007 | Anma et al. | 347/86 |
| 7,237,881 | B2 | 7/2007 | Hayasaki et al. | 347/86 |
| 7,252,376 | B2 | 8/2007 | Hatasa et al. | 347/86 |
| 7,325,892 | B2 * | 2/2008 | Nishihara | 347/7 |
| 2005/0219303 | A1 | 10/2005 | Matsumoto et al. | 347/19 |
| 2005/0219336 | A1 | 10/2005 | Hayasaki et al. | 347/86 |
| 2006/0139422 | A1 | 6/2006 | Hatasa et al. | 347/86 |
| 2006/0244795 | A1 | 11/2006 | Hayasaki et al. | 347/86 |
| 2006/0290722 | A1 | 12/2006 | Kitagawa et al. | 347/7 |
| 2007/0195141 | A1 | 8/2007 | Anma et al. | 347/86 |

FOREIGN PATENT DOCUMENTS

| | | |
|---|---|---|
| JP | 4-275156 | 9/1992 |
| JP | 2002-301829 | 10/2002 |
| JP | 2006-142484 | 6/2006 |
| WO | 2006/129882 | 12/2006 |

* cited by examiner

*Primary Examiner*—Lamson D Nguyen
(74) *Attorney, Agent, or Firm*—Fitzpatrick, Cella, Harper & Scinto

(57) ABSTRACT

A control section of each ink tank detects a difference in voltage value between a voltage value of an output data signal and a voltage value of an input data signal through the differential detector. When a plurality of ink tanks of the same color are mounted, this voltage difference carries a value different from a voltage of the original output data signal. Accordingly, by detecting this voltage difference, it can be detected that the plurality of the ink tanks of the same color are mounted, these ink tanks can be specified and identified, and be controlled individually.

6 Claims, 23 Drawing Sheets

LIQUID CONTAINER AND INK JET PRINTING APPARATUS

BACKGROUND OF THE INVENTION

1. Field of the Invention

The present invention relates to a liquid container and an ink jet printing apparatus and in particular, to a display control of light-emitting means such as a LED for indicating a mounting state or a liquid remaining amount of a liquid container such as an ink tank.

2. Description of the Related Art

There has been recently increasing a printing use (non-PC printing) due to spreading of digital cameras, in which the digital camera is directly connected to a printing apparatus not via personal computer (PC) for printing. There is also an increasing system where an information memory medium of a card type, which is an information memory medium used removably in the digital camera, is mounted directly to a printer for data transfer so as to perform printing (non-PC printing). There is well known a method of checking an ink remaining amount inside an ink tank of a printer on a monitor through a PC. Also in a case of performing the non-PC printing, there is an increasing demand for desiring of detecting the ink remaining amount inside the ink tank not via the PC. That is, if a user finds that the ink remaining amount inside the ink tank is small, the ink tank can be replaced with a new one before the printer starts a printing operation to prevent the situation where the printing can not be substantially made in the middle of the printing operation for lack of the ink.

There is known a system of using an indicating element such as a LED, as a structure of informing a user of such a state in the ink tank. Japanese Patent Laid-Open No. 4-275156 (1992) discloses a system where two LEDs are disposed in an ink tank integral with a printing head and respectively light up in accordance with two stages of an ink remaining amount. Japanese Patent Laid-Open No. 2002-301829 shows disposing in a tank a lamp which turns on in accordance with an ink remaining amount and also discloses a structure of disposing the lamp in each of four ink tanks used in a printing apparatus.

On the other hand, ink such as light magenta or light cyan having a lower concentration of coloring material has begun to be used in addition to conventional ink of four colors (black, yellow, magenta and cyan) in view of a demand for a higher image quality. In addition, ink of a particular color such as red or blue ink has been provided. In these cases, 7 or 8 ink tanks are to be mounted individually to an ink jet printer. On this occasion, it requires a mechanism for preventing the ink tank from being mounted in a wrong position.

In a case where a lamp is disposed in an ink tank, the ink tank where an ink remaining amount is small is required to be identified so that a signal for turning on the lamp is transmitted to the corresponding ink tank. When the ink tank is mounted in a wrong position, it has the possibility of displaying in the wrong that there is no ink remaining amount in the ink tank where the ink still remains in amount. Accordingly, a light-emitting control for a display such as a lamp is required to identify the mounting position of the ink tank.

Here, an example of structure for identifying mounting positions of ink tanks is shown as follows. Electrical contacts with which ink tank is equipped contact with electrical contacts with which a printer main body is equipped at a mounting position of a carriage or the like. The structure is adapted to set a signal line of a circuit formed by such contact as an individual signal line for each mounting position of the ink tanks. For example, a signal line for reading out ink color information of an ink tank from the corresponding ink tank and controlling lighting of a LED or the like is provided as an individual signal line for each mounting position of the ink tanks. According to this structure, when the read-out color information does not correspond to the mounting position of the ink tank, it results in that the ink tank is mounted in the wrong.

The structure where such signal line is individually disposed for each ink tank or each mounting position of the ink tanks leads to an increase of the number of signal lines. In particular, in a printer to use many kinds of ink tanks, the increasing number of signal lines is the cause of cost-up.

Japanese Patent Laid-Open No. 2006-142484 shows a structure of using a common signal line such as a bus connection for identifying an ink tank or performing display control of a display. Such bus connection helps in eliminating the number of wires, so that even when the number of ink tanks mounted increases as described above, it is possible to restrict an increase in costs.

Japanese Patent Laid-Open No. 2006-142484 describes a structure in which, for receiving and transmitting signals between a printer main body and an ink tank, color information of a tank is added to a data signal. According to the structure, the ink tank of the corresponding ink color recognizes the color information to recognize that the data signal is directed to itself. In addition, the printer main body recognizes the color information of the tank to recognize that the data signal relates to data from the ink tank of the corresponding color associated. For example, in a case of performing display control for an ink tank, first the printer main body identifies the ink tank based on the color information, and thereafter, transmits a control code associated with the display. Thereby, turning-on or turning-off of a LED can be made only with the side of the corresponding ink tank. While moving a carriage with the ink tank being mounted, lighting is performed at determined timing only in the corresponding ink tank. A sensor is disposed in a specified position along a moving path of the carriage. Whether or not the ink tank of the corresponding color is mounted in a correct position can be recognized depending on whether or not this sensor has detected the lighting of the ink tank at the determined timing.

In this way, the structure of using the bus connection for the signal line is advantageous in identifying the ink tank or performing the display control.

In a case of making communication between the printer main body and the ink tank by using the bus connection, however, it may be hard to identify the ink tank. This is a case where a user fails to distinguish among tanks and mounts a plurality of tanks having the same ink color. For example, this is a case where an ink tank of cyan ink is mounted in a correct position and another ink tank of the same cyan ink is wrongly mounted in a mounting position of an ink tank of blue ink. In this way, when the plural tanks of the same ink color are mounted, by the bus connection of the signal line, the same "color information" is added to a data signal and is then transmitted to the ink tanks. In this case, a plurality of ink tanks receive the same "color information", and then it is not possible to distinguish the mounted tanks of the same ink color from each other.

It is advantageous to detect that plural ink tanks of the same color are mounted by using a signal connection structure of the same bus connection without providing a new signal connection and to inform a user of the corresponding ink tank by the individual indication. This is because the problem with deterioration of a printed image due to wrong mounting of an ink tank can be prevented without attention by a user being paid so much.

SUMMARY OF THE INVENTION

An object of the present invention is to provide a liquid container and an ink jet printing apparatus in which even when plural liquid containers of the same color or of the same kind are mounted, the liquid containers are distinguished and identified to enable control based upon it.

In the first aspect of the present invention, there is provided a liquid container that is provided with a container portion for storing a liquid and a control section capable of making a signal connection with a control circuit of a printing apparatus through a common signal line to the liquid container and other liquid container, the liquid container comprising: detecting means for detecting a wave form C according to a difference between a wave form A of a signal outputted from the control section and passing through the common signal line and a wave form B of a signal inputted into the control section through the common signal line; and transmitting means for, when the wave form C detected by the detecting means differs from the wave form A of the outputted signal, transmitting information indicating that the wave forms differ from each other to the control circuit of the printing apparatus through the common signal line.

In the second aspect of the present invention, there is provided an ink jet printing apparatus in which a plurality of ink tanks are removably mounted and which performs printing by ejecting ink from a printing head, the ink being supplied from the mounted ink tanks to the printing head, the printing apparatus comprising: a control circuit; and a common signal line the for making a signal connection between the control circuit and the plurality of ink tanks, the common signal line being common to the plurality of ink tanks, wherein when information indicating that a wave form C according to a difference between a wave form A of a signal outputted from control sections of the ink tanks and passing through the common signal line and a wave form B of a signal inputted into the control section through the common signal line differs from the wave form A of the outputted signal is transmitted to the control circuit through the common signal line, the control circuit executes a control in accordance with the received information.

According to the above structure, even when the plural liquid containers of the same kind, which make signal connection to a control circuit of an apparatus main body with a common signal line, are mounted, each of the liquid containers can be identified. There can be further provided a liquid container which allows respective unique numbers specific to plural liquid containers of the same kind to be acquired from the liquid containers through a common signal line, without overlapping. As a result, there can be provided an ink jet printing apparatus which can control the plural liquid containers of the same kind distinguishably and identifiably.

Further features of the present invention will become apparent from the following description of exemplary embodiments (with reference to the attached drawings).

DESCRIPTION OF THE EMBODIMENTS

Hereinafter, embodiments of the present invention will be in detail explained with the accompanying drawings.

Figure 1A:
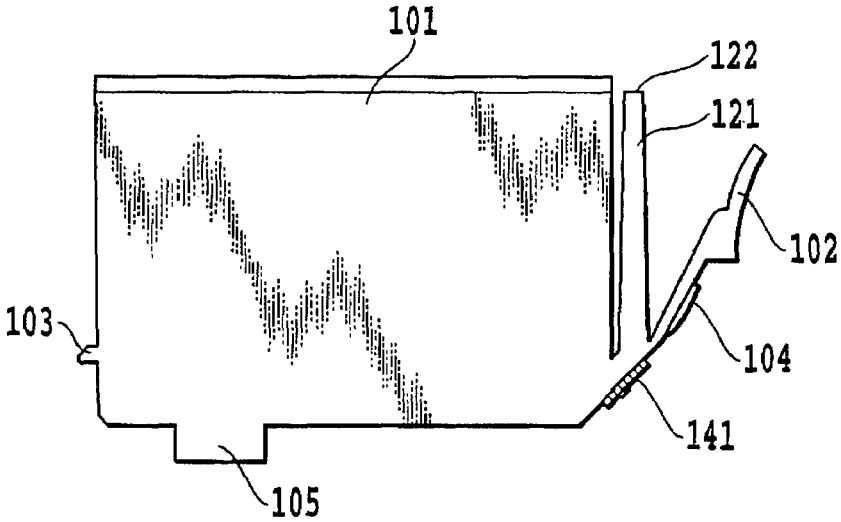
FIG. 1A is a side view of an ink tank in a first embodiment.
Figure 1B:
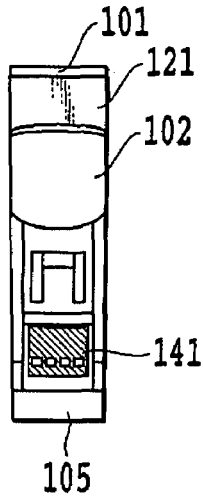
FIG. 1B is a front view of an ink tank in a first embodiment.
Figure 1C:
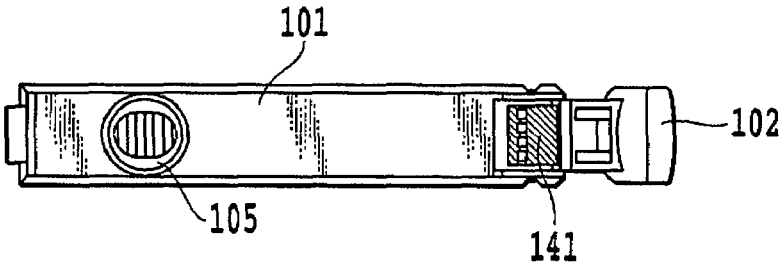
FIG. 1C is a bottom view of an ink tank in a first embodiment.

FIG. 1A, FIG. 1B and FIG. 1C respectively are a side view, a front view and a bottom view of an ink tank according to an embodiment of the present invention.

As shown in FIGS. 1A to 1C, an ink tank 101 is equipped with a support member 102 that is supported at a lower part of the front side of the ink tank. The support member 102 is made of resin, integral with an exterior member of the ink tank 101. In addition, the support member 102 is structured so as to be shifted around a support part when mounted to a tank holder to be described later. The ink tank 101 is provided with a first engagement portion 103 at the back side and a second engagement portion 104 (integral with the support member 102 in this embodiment) at the front side of the ink tank, which are engaged to corresponding engagement portions in the tank holder. These engagements ensure a mounting state of the ink tank 101 to the tank holder.

The ink tank 101 is provided with an ink supply port 105 at the bottom surface, which port joins to an ink introducing port of a printing head at the time of mounting the ink tank 101 to the tank holder. Abase substrate is provided in a corner portion where the bottom surface and the front surface of the ink tank 101 intersect. The base substrate may be formed in a chip shape or a sheet shape and hereinafter, will be described as a base plate 141. In addition, a light guiding member 121 is provided between the support member 102 and the exterior of the ink tank 101. The light guiding member 121 is formed of resin, integral with the exterior of the ink tank 101, similarly to the support member 102.

Figure 2A:
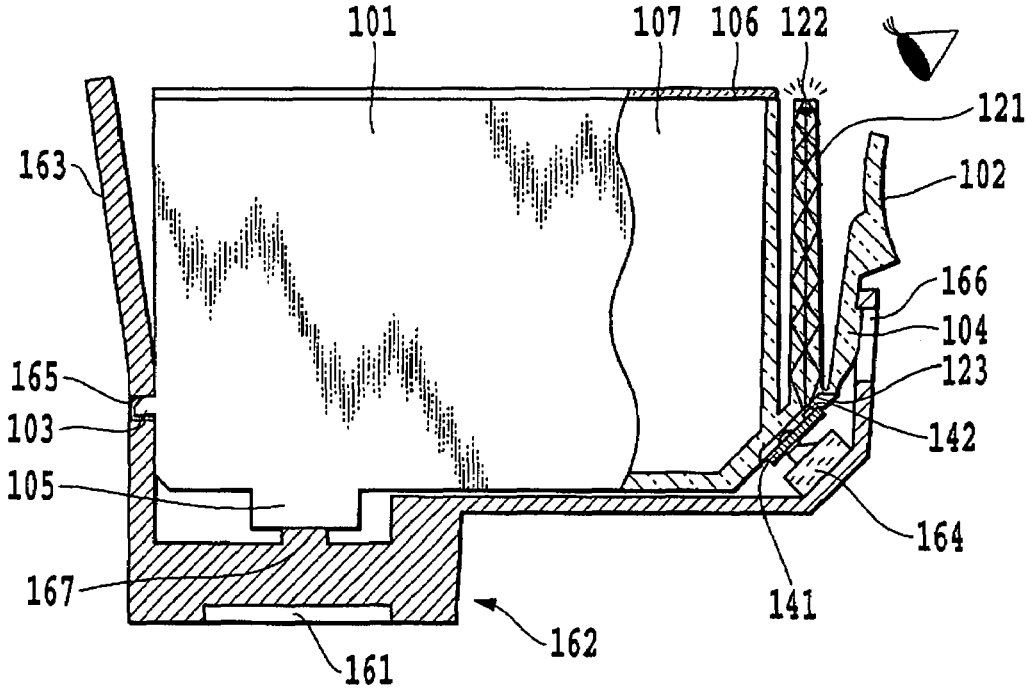
FIG. 2A is a cross section of a light guiding member.
Figure 2B:
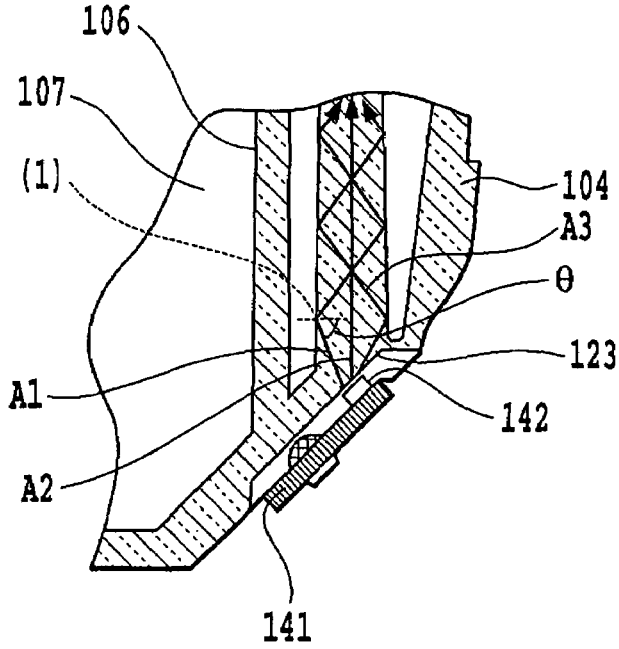
FIG. 2B is an enlarged view of a light guiding member.
Figure 3A:
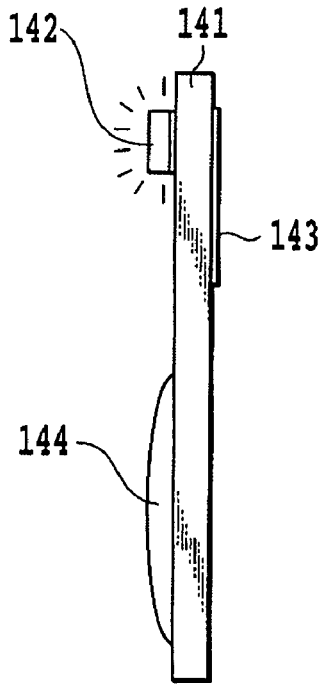
FIG. 3A is a side view of a base plate mounted to an ink tank.
Figure 3B:
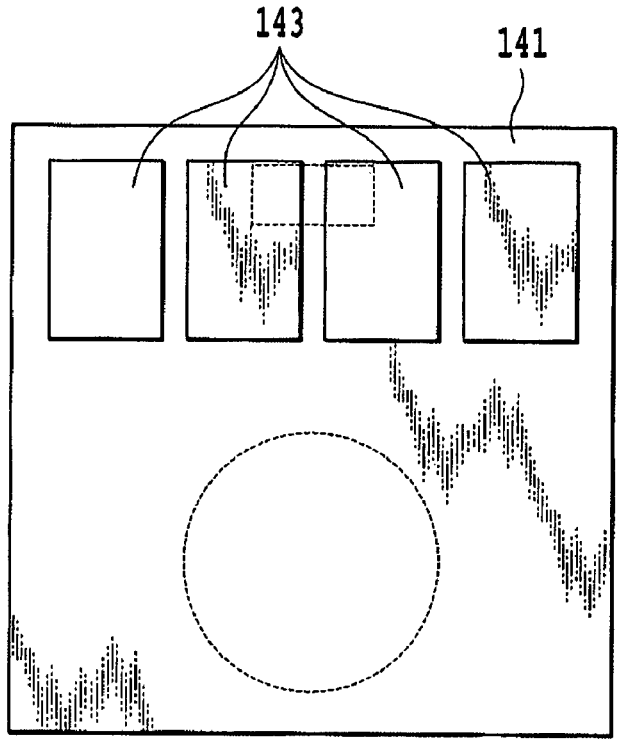
FIG. 3B is a front view of a base plate mounted to an ink tank.

FIG. 2A and FIG. 2B are schematic cross sections mainly explaining a structure of a light guiding member in the embodiment. In addition, FIG. 3A and FIG. 3B are a side view and a front view each showing an example of the base plate 141 mounted in an ink tank of the embodiment.

The first engagement portion 103 and the second engagement portion 104 of the ink tank 101 respectively are engaged to a first locking part 165 and a second locking part 166 of a holder 163 which is integral with a printing head unit 162 provided with a printing head 161. This engagement causes the ink tank 101 to be mounted and fixed to the holder 163.

In this engagement, a contact point (hereinafter, referred to as "connector") 164 disposed in the holder 163 is in contact with an electrode pad 143 (FIG. 3B) as a contact point disposed on a surface of the base plate 141 facing an outside of the ink tank 101, on which the base plate is disposed, to form an electrical connection therebetween.

Inside the ink tank 101, an ink containing chamber 106 for containing ink 107 is disposed at a front side of the ink tank 101 and a negative pressure generating member containing chamber (not shown) for containing a negative pressure generating member (not shown) which communicates with the ink supply port 105 are disposed at a backside of the ink tank 101. The ink is stored in the ink containing chamber 106 as it is, while an ink absorbing member (not shown, hereinafter referred to as "porous member" for convenience) such as a sponge or a fiber aggregate impregnating and holding the ink is disposed in the negative pressure generating member containing chamber. This porous member functions to generate an appropriate negative pressure which is sufficient for preventing ink leak from an ink ejection opening in equilibrium with a holding force of a mechanism formed in a nozzle portion for ink ejection of the printing head 161 and also is in a range where the ink ejection operation of the printing head 161 can be made.

It should be noted that the inner structure of the ink tank 101 is not limited to that which is divided into the containing chamber for this porous member and the containing chamber for storing the ink as it is. For example, the porous member may be substantially filled in an entire inner space of the ink tank 101. The negative pressure generating means may be a tank in which ink is directly filled inside a bag-shaped member made of an elastic material generating a tension in a direction of expanding the volume and the tension generated by this bag-shaped member applies negative pressure to the ink therein. Further, at least a part of an ink storage space may be formed of a flexible member, wherein the ink only is stored in this space and also a spring force is applied to the flexible member to generate negative pressure.

The base plate 141 is provided with a LED 142 for emitting a visible light such as LED, a memory element for storing information and a control element for controlling a light-emitting element, on a surface of the plate. Particularly, in the embodiment, the memory element and the control element are disposed integrally as an IC package on the base plate and an electrical signal transmitted via a pad 143 from the connector 164 causes the control element inside the IC package 144 to control light-emitting of the light-emitting portion 142.

In addition, for controlling attenuation of light content at the time of introducing light emitted from the LED 142 on the light guiding portion 121, the base plate 141 is disposed so that the LED 142 is in a position close to an incident surface 123.

FIG. 2B shows an enlarged view showing a portion in the neighborhood of a root of the light guiding portion in FIG. 2A. As shown in FIG. 2B, the light emitted from the LED 142 is introduced from the incident surface 123 as an end face of the light guiding portion 121, passes through the light guiding portion 121 and reaches to a display portion 122 lights up for a user. The LED 142 adopts visible light as described above and emits scattering light, and therefore, includes a plurality of light rays like A1 to A3.

Here, the exterior of the ink tank 101, as described above, adopts polypropylene and the light guiding portion 121 is integral with the exterior of the ink tank 101. Therefore, the light guiding portion 121 is made of the same material as that of the ink tank 101. Since a refraction index of the polypropylene is 1.49 and a refraction index of air is 1.00, a critical refraction angle from polypropylene to air is approximately 43° according to $n1 \sin \theta 1 = n2 \sin \theta 2$ as Snell's law. In consequence, the light ray in which an incident angle θ in a point (1) of FIG. 2B is equal to 43° or more is reflected totally on the boundary face between polypropylene (light guiding portion 121) and air and is repeatedly reflected totally inside the light guiding portion 121 as shown in an arrow A1 or A3 to reach the display portion 122.

By thus providing the light guiding member 121 in the ink tank 101, it is possible to individually dispose the LED 142 and the display portion 122 at optimal positions cheaply without the necessity of wires for communicating an electric power source or signals. This ensures degrees of freedom of disposition of the display portion 122 in a position which a user easily recognizes it, so that a user can recognize certain information relating to the ink tank 101 by visual observation of the light-emitting state. In addition, the light guiding portion 121 is made integral with the exterior of the ink tank 101, whereby the display portion 122 can be disposed without the cost-up.

The certain information of the ink tank 101 means a correct/wrong mounting state (whether or not the mounting is complete), for example. Besides, it means a correct/wrong mounting position (whether or not the ink tank 101 is correctly mounted in a mounting position on the holder predetermined corresponding to the ink color. It further includes presence/absence of an ink remaining (whether or not the sufficient amount of ink remains) or the like. Showing of these pieces of the information can be made by presence/absence of light-emitting or a state of light-emitting (flashing or the like).

It should be noted that in the ink tank 101, light-emitting of the LED 142 is confirmed at manufacturing and at the same time, the light-emitting light content is checked. The checking of the light-emitting light content is made by recognizing strength of light which emits from the LED 142, passes through the light guiding portion 121 and reaches the display portion 122, with a sensor at manufacturing process. In addition, the light content is classified into rank information of plural steps in accordance with the strength of the light and the rank information is written into a memory element inside the IC package 144 provided in each ink tank 101. At the same time, a color (color ID) injected into the ink tank 101, an individual code different for each ink tank, and other information such as an injection date, an injection amount are written into the memory element.

Figure 4:
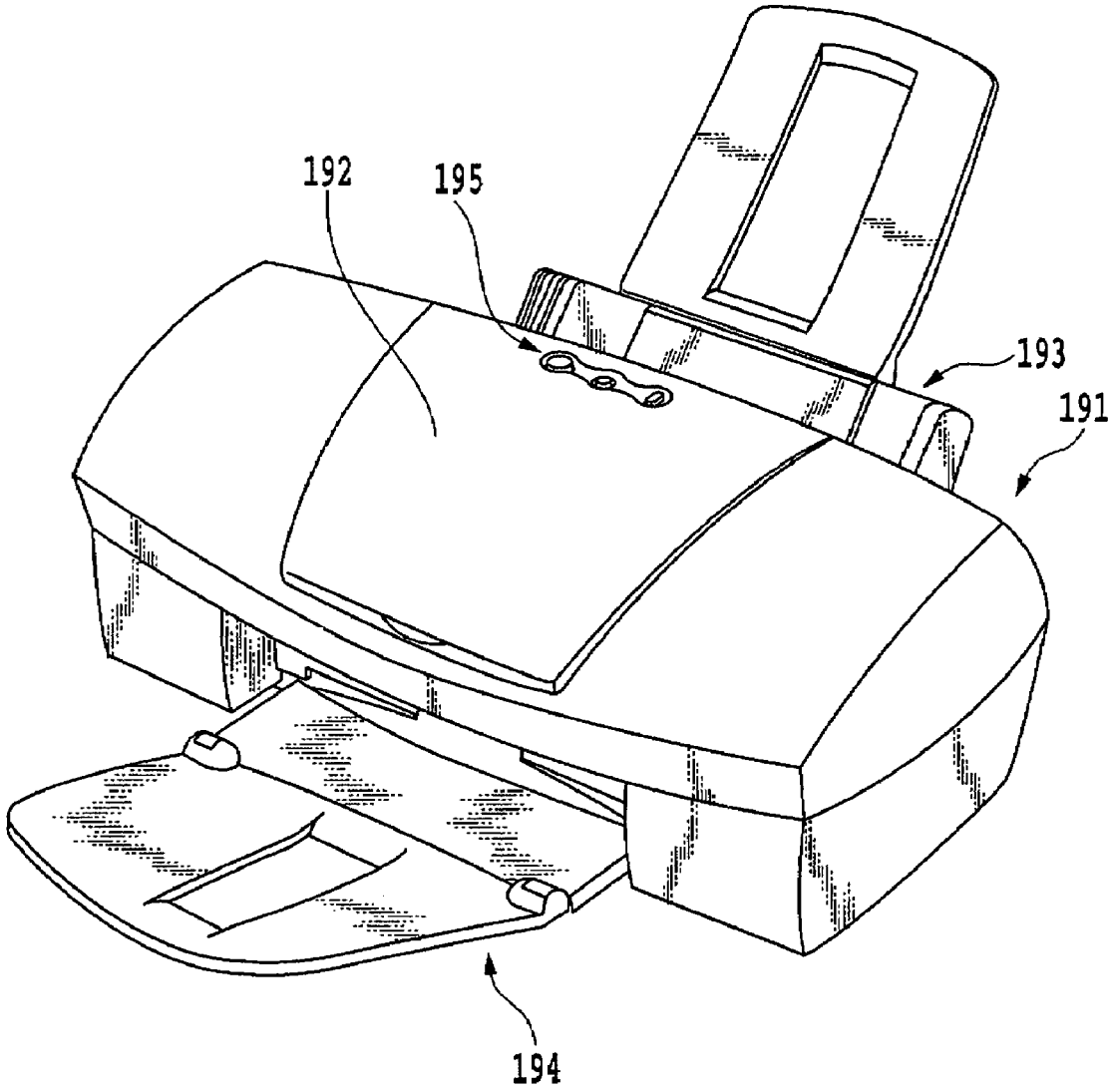
FIG. 4 is a perspective view of an outside appearance of an ink jet printer.
Figure 5:
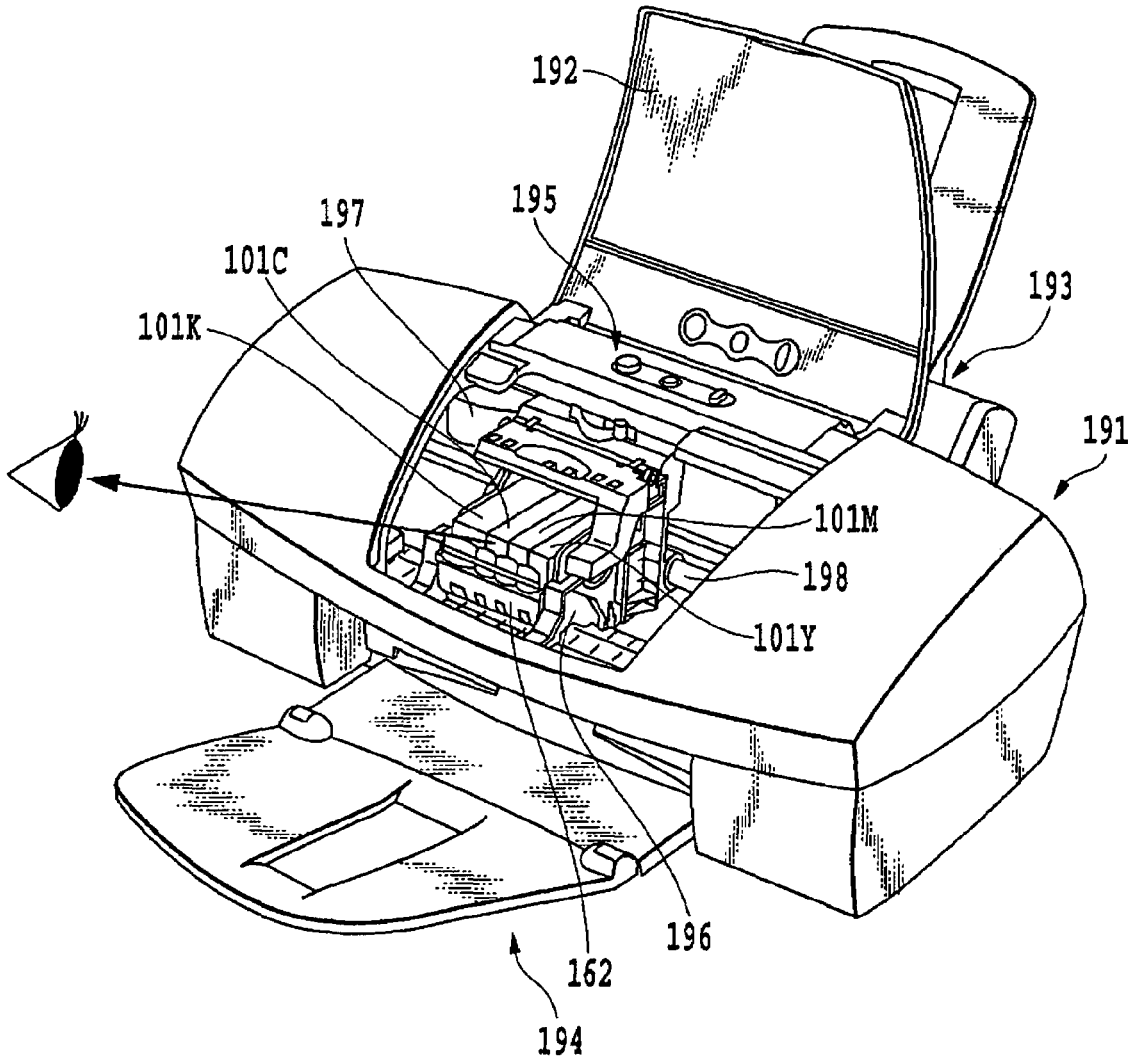
FIG. 5 is a perspective view of a state where a main body cover of an ink jet printer is opened.

FIG. 4 is a perspective view showing an outside appearance of an ink jet printer 191 which is provided with the ink tank as described above and performs the printing. FIG. 5 is a perspective view showing a state where a main body cover 192 shown in FIG. 4 is opened. The ink jet printer to be explained in the embodiment is a color printer provided with the ink tank 101 in which each ink of black, yellow, magenta and cyan is injected.

In the printer 191 of the embodiment, a major part of the printer including a mechanism for performing printing by moving the carriage to which the printing heads and the ink tanks are mounted to execute a scanning operation is covered with the main body cover 192 and the other casing portions. The printer 191 is provided with the printer main body, delivery trays 194 disposed before and behind the printer main body and an automatic feeder (ASF) 193. In addition, the printer 191 is provided with a display for displaying a state of the printer with regard to each of states where the main body cover is opened and closed, and an operation portion 195 provided with a power source switch and a reset switch.

In a state where the main body cover 192 is opened, a user can observe a range where the carriage 196 provided with the printing head unit 162, a black tank 101K, a yellow tank 101Y, a magenta tank 101M and a cyan tank 101C moves and the circumference thereof. Hereinafter, these ink tanks may be shown in the same code "101" for explanation.

When the main body cover 192 is opened, the sequence is executed for automatically moving the carriage 196 to a nearly central position shown in FIG. 5 (hereinafter referred to as "ink tank replacement position). A user can perform a replacement operation of each ink tank at the ink tank replacement position.

The printing head unit 162 is provided with a printing head (not shown) of a chip form corresponding to the ink of each color. The printing head of each color scans a printing medium such as a paper by moving the carriage 196 and ejects ink on the printing medium during scanning to perform the printing. That is, the carriage 196 is slidably engaged to a shaft 198 extending in the moving direction and also can perform the aforementioned transfer by a carriage motor and the drive force transmission mechanism. In addition, an ejection data is transmitted to each printing head corresponding to ink of K, Y, M and C via a flexible cable 197 from a control circuit of the main body. An ink ejection is performed based upon these ejection data. A feed mechanism such as a feed roller or a discharge roller is provided to carry a printing medium (not shown) fed from the automatic feeder 193 to the delivery tray 194. The printing head unit 162 integral with the tank holder is removably mounted to the carriage 196 and on the other hand, the each ink tank 101 is removably mounted to the printing head unit 162.

The printing head scans by moving the carriage and ejects ink on the printing medium during scanning for printing. The printing is made across the scanning direction width of the printing head in a region of the corresponding printing medium width. A certain amount of paper feeding is made in accordance with a width in a direction crossing with the scanning direction of the head by the feed mechanism between the present scanning and the next scanning of the printing head. The printing is sequentially made on the printing medium by such printing operation.

An ejection recovery unit such as a cap is disposed in an end of the moving range of the printing head by the carriage for covering a face where ejection openings of each printing head are disposed. Thereby, the printing head moves to a position where the recovery unit is disposed by a predetermined time interval to execute a recovery processing such as a preliminary ejection.

The printing head unit 162 equipped with a tank holder portion of each ink tank 101 is provided with a connector corresponding to each ink tank. Each connector is in contact with a pad of the base plate disposed in the ink tank 101 which is mounted. Contact between the connector and the pad allows each LED (light-emitting) 142 to be controlled so as to light up and flash according to the determined sequence.

In the ink tank replacement position, when an ink remaining amount in each ink tank becomes small, the LED 142 of the corresponding ink tank 101 is controlled to light up or flash. The light of the LED passes through the light guiding portion and the display portion 122 lights up or flashes. In another example of controlling lighting of the LED, when the ink tank 101 is correctly mounted in the ink tank replacement position, the LED 142 of the ink tank may be controlled to light up. These controls are, in the same way with the control such as ink ejection of the printing head, performed by transmitting the control data (control signal) via the flexible cable 197 from the control circuit of the main body to each ink tank.

Figure 6:
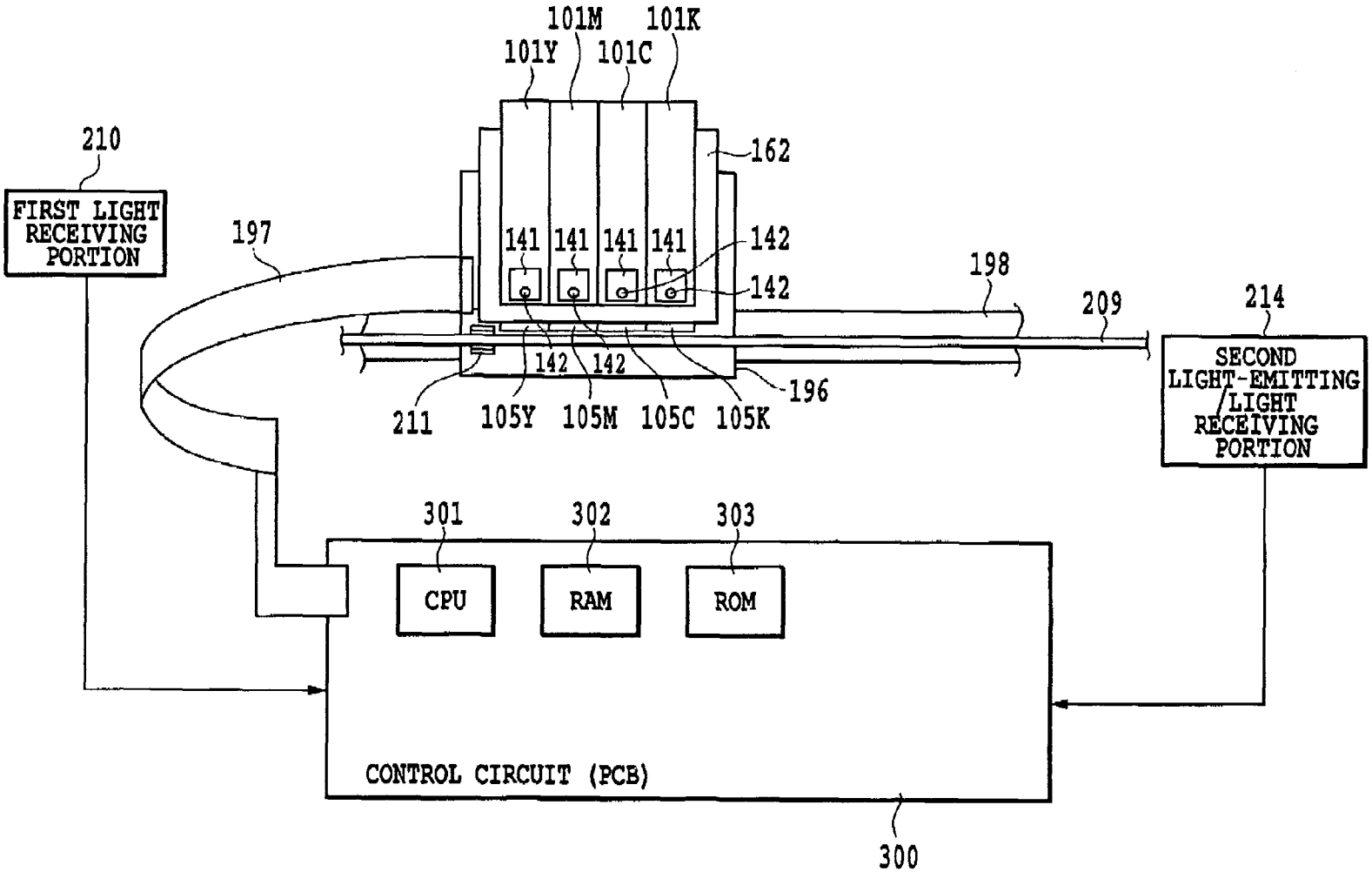
FIG. 6 is a block diagram showing a control structure of an ink jet printer.

FIG. 6 is a block diagram showing a control structure of an ink jet printer. This figure shows mainly a control circuit of a PCB (printed circuit board) form in the printer main body and a structure for light-emitting of a LED of an ink tank controlled by the control circuit.

In FIG. 6, the control circuit 300 performs data processing and an operational control of the printer. A CPU 301 performs the processing to be described later in FIG. 12 according to the program stored in a ROM 303. A RAM 302 is used as a work area at the time of the processing execution by the CPU 301.

The printing head unit 162 on the carriage 196 is provided with the printing head of each color. Each printing head (chip) 105K, 105Y, 105M and 105C is provided with ejection openings of black (K), yellow (Y), magenta (M) and cyan (C) for ejecting the ink, respectively. The ink tanks 101K, 101Y, 101M and 101C of respective colors are removably mounted in the holder of the printing head unit 162 so as to correspond to these printing heads.

The base plate 141 provided with LED 142, the display control circuit, a pad as a contact terminal and the like is mounted in each ink tank 101. When the ink tank 101 is correctly mounted in the printing head unit 162, the pad on the base plate 141 is in contact with the connector disposed in the printing head unit corresponding to each of the ink tanks 101.

In addition, the connector (not shown) disposed in the carriage 196 is in signal connection with the control circuit 300 of the main body side via the flexible cable 197. Further, the printing head unit 162 is mounted in the carriage 196, so that the connector of the carriage 196 is in signal connection with the connector of the printing head unit 162.

This connection allows receiving and transmitting signals between the control circuit 300 of the main body and each ink tank 101. The control circuit 300 can perform control of lighting or flashing according to the sequence to be described later in FIGS. 19 and 20.

Likewise, a drive circuit disposed in each of the printing heads 105K, 105Y, 105M and 105C is in signal connection with the control circuit 300 of the main body. This causes the control circuit 300 to control ink ejection or the like in each printing head.

A first light receiving portion 210 disposed near one end of the moving range of the carriage 196 receives light emitted from the LED 142 of the ink tank 101 to output a signal in response to the emitted light to the control circuit 300. The control circuit 300 can determine a position of each ink tank 101 on the carriage 196, based upon this signal.

An encoder scale 209 is disposed along the moving route of the carriage 196 and the carriage 205 is provided with an encoder sensor 211. The detection signal of the sensor is inputted via the flexible cable 197 to the control circuit 300 to detect the moving position of the carriage 196. This position information is used for ejection control of each printing head and is also used in authentication processing with use of light for detecting the ink tank position as described later in FIG. 19 or the like.

A second light-emitting/light-receiving element 214 disposed in the moving range of the carriage 196 includes a light-emitting element and a light-receiving element, and outputs a signal relating to an ink remaining amount in each ink tank 101 mounted in the carriage 196, to the control circuit 300. The control circuit 300 can detect the ink remaining amount based upon this signal.

Figure 7:
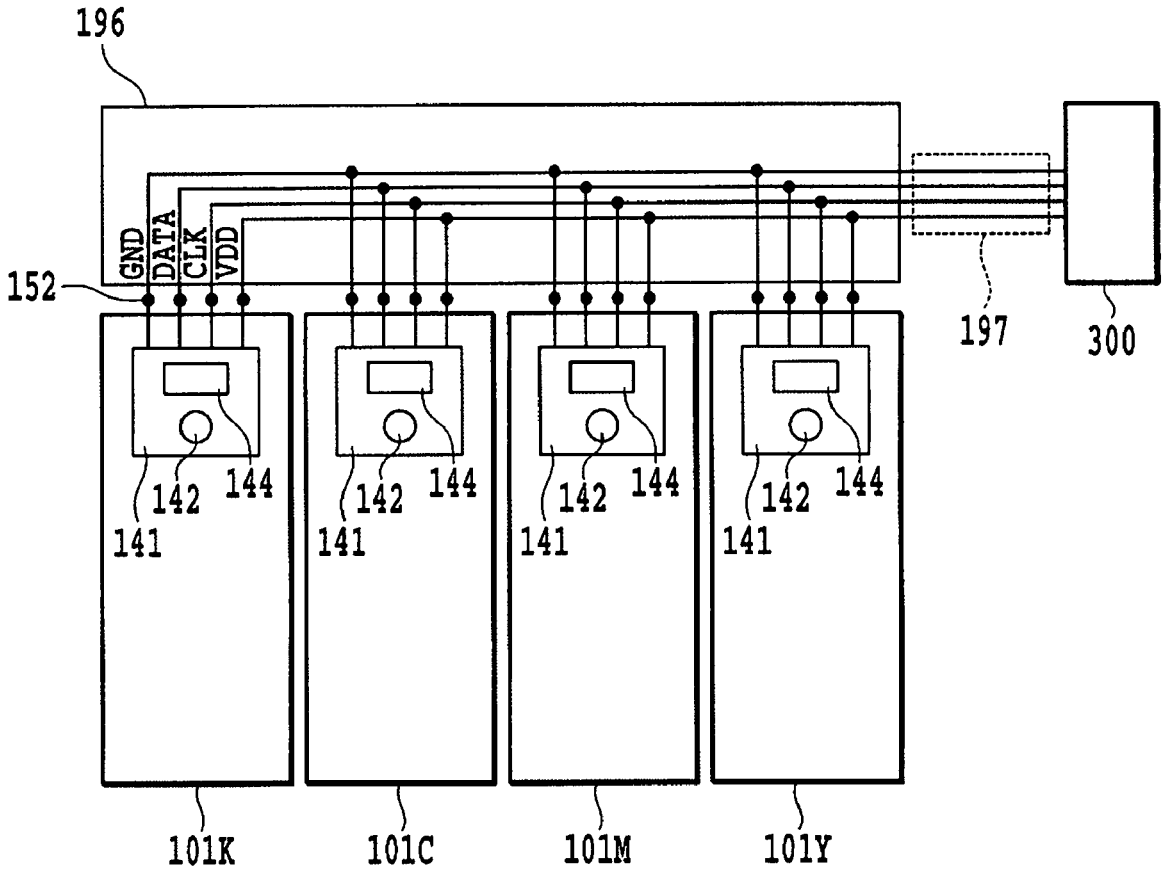
FIG. 7 is an explanatory diagram showing signal wiring in flexible cables with tanks.

FIG. 7 is a diagram showing a structure of signal wiring in the flexible cable 197 for signal connection to the ink tank 101, based on a relation with the base plate 141 of each ink tank 101.

As shown in FIG. 7, the signal wiring to each ink tank 101 is composed of four signal lines. In addition, the four signal lines are the common signal wiring (bus connection) in four ink tanks 101. The signal wiring to each ink tank 101 includes a power source signal line "VDD" for the power supply to operate functional elements in the IC package 144. The functional elements perform light-emitting and the driving of the LED 142. In addition, the signal wiring also includes an earth signal line "GND", a signal "DATA" for transmitting control signals relating to the processing such as lighting or flashing of the LED 142 from the control circuit 300, and the clock signal line "CLK".

An example of the four signal lines is explained in the embodiment, but the present invention is not limited to this. For example, it is possible to omit "GND" line by achieving an earth signal with a different structure. Signal lines of "CLK" and "DATA" may be shared by a single signal line. In this structure, it is not required to dispose the signal line "DATA" for each ink tank 101, reducing the signal wiring in the flexible cable 197.

Such bus connection can reduce the number of the signal lines and solve the problem with an increase in costs. For example, a printer with ink tanks of eight colors without use of the bus connection is explained as follows. In a case of disposing the signal line "DATA" for each ink tank, it requires eleven wires including the power source signals "VDD", the earth signal lines "GND", the clock signal lines "CLK". On the other hand, in a case of using the bus connection, four signal lines only are basically sufficient even when ink tanks of eight colors are used.

The base plate 141 of each ink tank 101 is provided with the IC package 144 operated by the four signal lines and the LED 142 operated by the operation of the IC package 144.

Figure 8:
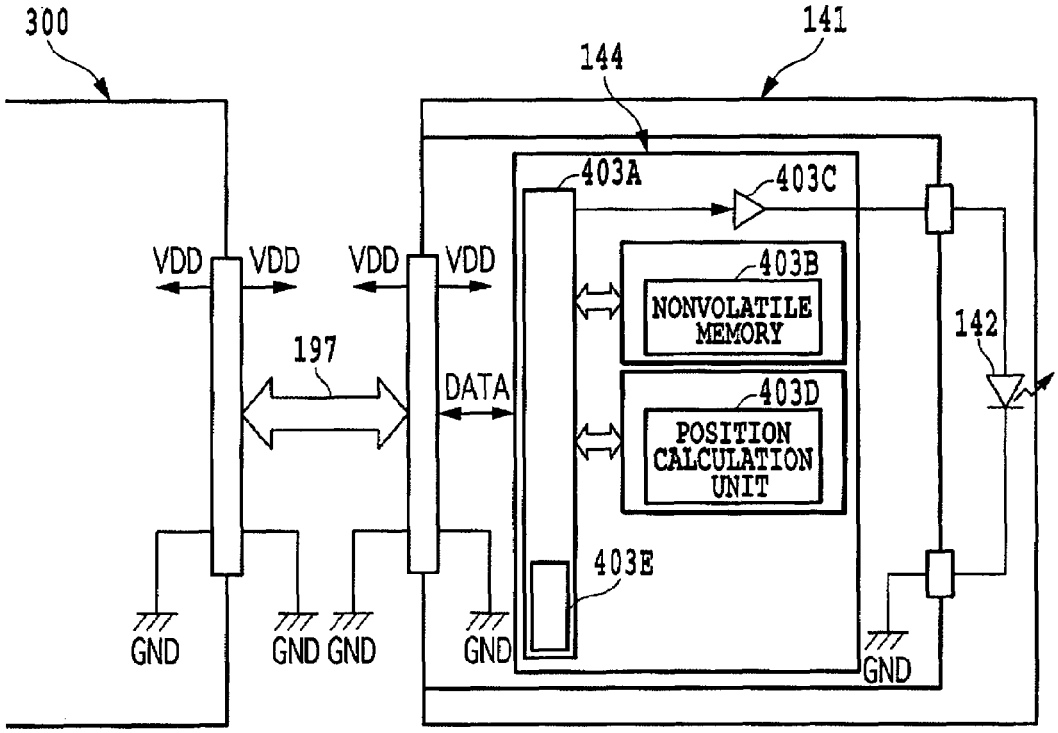
FIG. 8 is a circuit diagram of a structure where an IC package is disposed in a base plate.

FIG. 8 is a circuit diagram showing a detail of the base plate provided with the IC package.

The control section 144 as the IC package is structured of an input/output control circuit (I/O CTRL) 403A, a memory array 403B, a LED driver 403C and a position calculation unit 403D.

The input/output control circuit (I/O CTRL) 403A includes a differential detector 403E for detecting a difference between input and output voltages. The input/output control circuit 403A controls a display drive of the LED 142 in accordance with control data transmitted via the flexible cable 197 from the control circuit 300 of the main body. In addition, it controls writing-in and reading-out of data to the memory array 403B and the receiving and the transmitting of data to the position calculation unit 403D.

The memory array 403B is composed of an EEPROM in the embodiment and can store an ink remaining amount, color information of ink to be stored in the ink tank and besides, manufacturing information such as a unique number and a manufacturing lot number of each ink tank. The color information is written in an address of the memory array 403B in accordance with color of the ink stored at shipment or manufacturing of the ink tank. Further, the color information is used as identification information for the ink tank. The ink tank is identified by using the color information to perform the writing-in of data to the memory array 403B and the reading-out of data from the memory array 403B. Further, the lighting and turning off a light of the LED 142 of the identified tank can be controlled.

The unique number is also written in an address defined in the memory array 403B at shipment or manufacturing of the ink tank. One unique number is allotted to one ink tank and there exists no other ink tank having the same unique number. The unique number differs even in the ink tank of the same color. It is require to in advance allot a memory region for storing the number of the unique numbers which corresponds to the number of ink tanks which are manufactured. The digit number is greater than the color information. A unique number, when a plurality of ink tanks of the same color are mounted, is used as an identification number of each ink tank. By performing the processing or the calculation using unique numbers, even when a plurality of ink tanks of the same color are mounted, individual ink tanks can be distinguished and identified. Based on the identification of the ink tank, it is possible to perform the writing-in of the data to the memory array 403B of the identified ink tank to or the reading-out of the data from the memory array 403B thereof. In addition, it is possible to control lighting and turning off the light of the LED 142 of the identified ink tank.

An example of data written in the memory array 403B or data read out therefrom may include data of an ink remaining amount. The ink tank of the embodiment is provided with a prism disposed at the bottom for optically detecting a remaining amount of the ink via this prism when the remaining amount becomes small. Further, the ejection number of each printing head is counted based upon the ejection data in the control circuit 300. The ink remaining amount of each ink tank is calculated based upon the count value. The remaining information of the ink is written in the memory array 403b of the corresponding ink tank or read out therefrom. The control circuit 300 can retain the information of the ink remaining amount at this point. This information is used in combination with the ink remaining detection using the prism to detect ink remaining amount more accurately. This information is also used for determining whether the mounted ink tank is a new one or an ink tank once used and remounted.

The LED driver 403C operates to apply a power source voltage to the LED 142 to light the LED 142 when a signal outputted from the input/output control circuit 403A is ON. When the signal outputted from the input/output control circuit 403A is ON, the LED 142 becomes in a lighting up state and when the signal outputted from the input/output control circuit 403A is OFF, the LED 142 becomes in a turned off light state.

Figure 9:
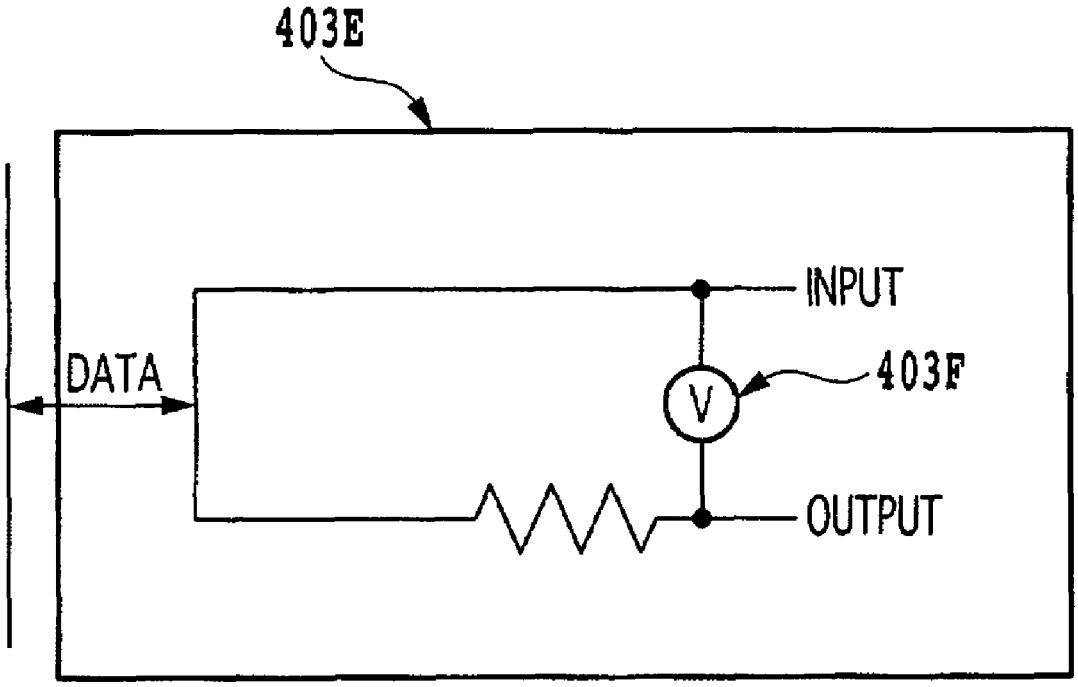
FIG. 9 is a structure diagram of a differential detector.

FIG. 9 is a diagram showing a detailed structure of the differential detector 403E shown in FIG. 8. Control data from the control circuit 300 of the main body are inputted/outputted via the common signal line "DATA" shown in FIG. 7. An inside of the differential detector 403E is divided into a line for input and a line for output upon inputting/outputting the control data. A comparator 403F measures a voltage difference between the input and output voltages. A voltage value of each of the input and output lines is held as it is so long as the input or output voltage is not further supplied. Regardless of input/output timing, it is possible to execute the processing of detecting a difference between a signal voltage outputted from the ink tank and a signal voltage inputted to the ink tank from the main body. The signal voltage inputted to the ink tank means a voltage shown in a signal on the signal line "DATA". The control section 144 can determine whether or not another ink tank of the same color with the ink tank mounting the control section 144 thereon is mounted based upon a difference between the input and output voltages.

Figure 10:
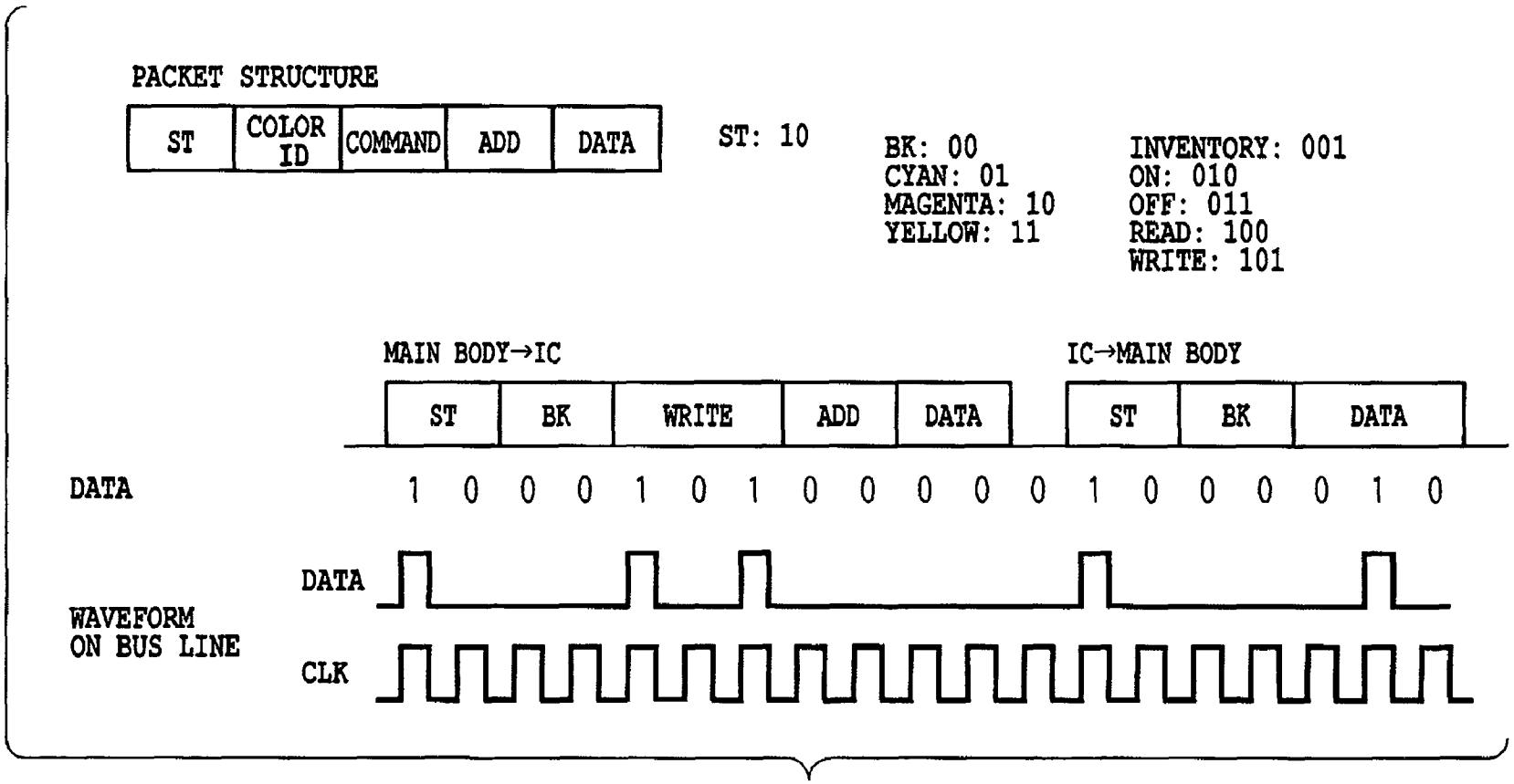
FIG. 10 is a timing chart showing a basic operation of data to a memory array.
Figure 11:
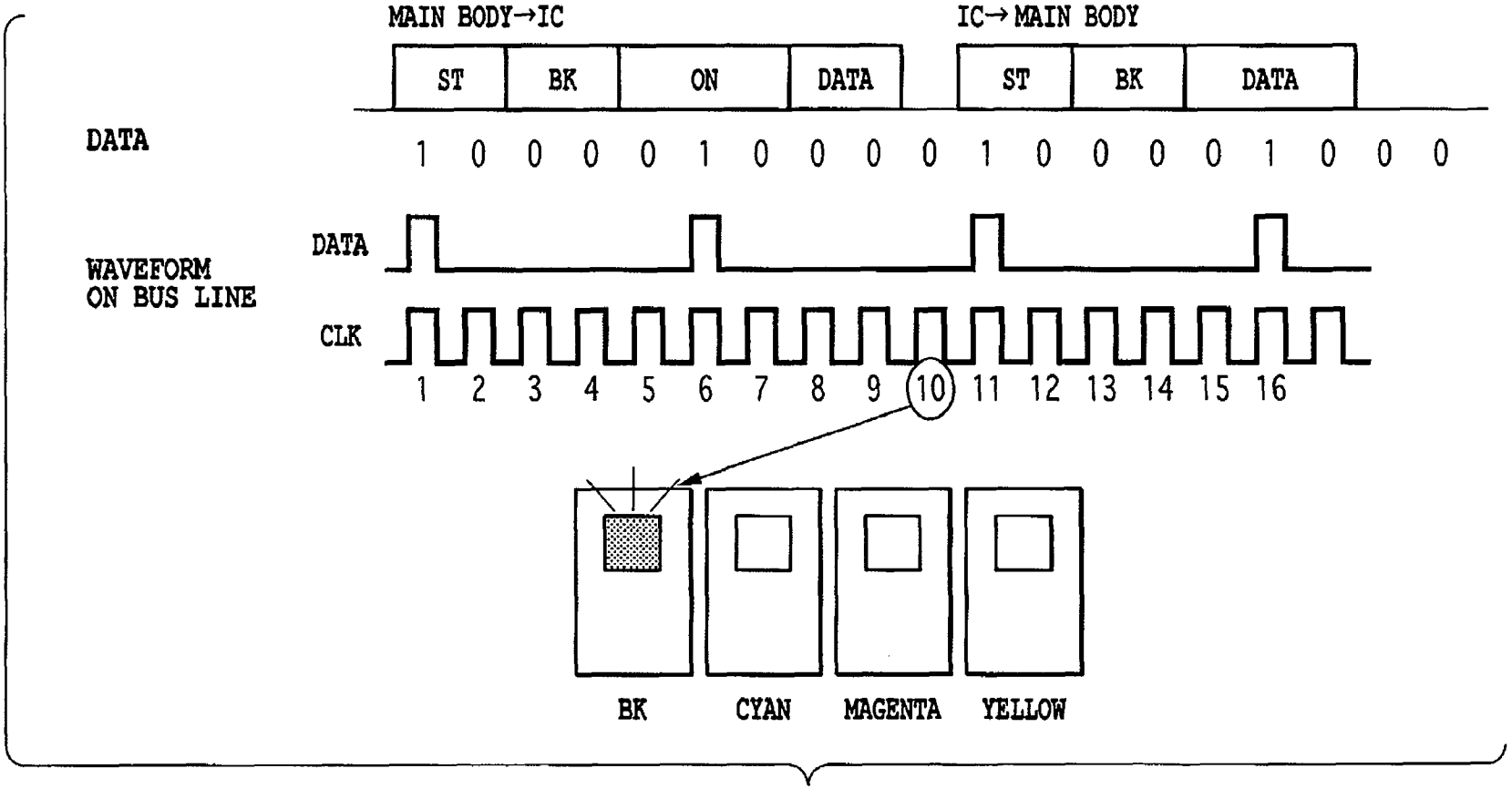
FIG. 11 is a timing chart showing a Led lighting control.

FIG. 10 is a timing chart showing for explaining a basic operation of each of the writing data to and the reading data from the memory array 403B. FIG. 11 is, likewise, a timing chart showing for explaining a basic operation of each of the lighting up and turning off the light of the LED 142.

A data signal of a packet structure is transmitted via the signal line "DATA" to the input/output control circuit 403A of the ink tank control section 144 from the control circuit 300 of the main body. A data signal of a similar packet structure is transmitted to the printer main body from the control section 144.

The data signals from the main body include each data signal of "start code (ST)+color information (color ID)", "control code (COMMAND)", "address code (ADD)", and "data code (DATA)". The data signals from the ink tank control section 144 to the main body basically include each data signal of "start code (ST)+color information (color ID)" and "data code (DATA)".

Among the data signal of "start code+color information", the "start code" signal means start of a series of data signals. Further, the "color information" signal identifies the ink tank which is an object of the series of the data signals. "Color" of ink is not limited to an ink color such as Y, M or C, but may include ink having a different concentration. "Color information" includes codes corresponding to ink colors of "K", "C", "M" and "Y".

The input/output control circuit 403A of the control section 144 in each ink tank compares the color information indicated by the code of the data signal from the main body with own color information stored in the memory array 403B. Only when the color information of both corresponds to each other, the processing of incorporating data signals after the inputted color information is executed. When the color information does not correspond to each other, the processing of ignoring the incorporation of and not outputting the data signals after the inputted color information is executed. In a case where the ink tank is mounted in a correct position, even when the data signal is commonly transmitted via the common signal line "DATA" shown in FIG. 7 from the main body to each ink tank, the ink tank can be identified. In addition, the processing based upon the data signals after that, such as writing-in, reading-out, and lighting and turning off the light of the LED can be executed only to the ink tank identified.

The data transmitted via one common data signal line to the four ink tanks are used to perform controls such as the writing data to the each ink tank, or the lighting and turning off the light of the LED. It is possible to reduce the number of signal lines required for these controls. The structure of using such common data signal line can be common regardless of the number of the ink tanks.

"Control code (COMMAND)" of the embodiment includes codes of "OFF" and "ON" used for controlling the lighting and turning off the light of the LED as shown in FIG. 10. Further the "Control code (COMMAND)" includes codes of "READ" and "WRITE" showing each of the reading from and the writing to the memory array. In an operation of the writing, the code of "WRITE" is to follow the code of "color information" identifying the ink tank. "Address code" shows an address of the memory array for the writing and "data code" represents the content of the writing. The content represented by "control code" may be used in addition of control codes such as a verified command, or a continuous reading-out command.

In controlling the lighting or the turning off the light of the LED 142, as shown in FIG. 11, the data signal of "start code+color information" is first transmitted via the signal line from the main body to the input/output control circuit 403A. The ink tank is first identified by "color information". The ink tank is identified by "color information". The lighting or the turning off the light of the LED 142 based upon "control code" following the color information is executed only in the identified ink tank. "Control code" relating to the lighting and the turning off the light includes "ON" and "OFF" respectively and the LED 142 turns on by "ON" and turns off by "OFF". When the control code is "ON", the input/output control circuit 403A outputs an ON signal to the LED driver 403C and maintains the output state after that. When the control code is "OFF", the input/output control circuit 403A outputs an OFF signal to the LED driver 403C and maintains the output state after that. In the embodiment, actual timing of the lighting or the turning off the light of the LED 142 is made after tenth clock of the clock CLK in regard to each data signal.

In FIG. 11, as shown in the data signal at the most left end, the ink tank of Bk is first identified and the LED 142 in the tank of Bk is ON. Next, for example, when "color information" of the data signal indicates MAGENTA and "control code" indicates lighting, the LED 142 in the tank of ink Bk remains to be ON, and at the same time, the LED 142 in the tank of ink MAGENTA is also turned ON. In addition, when the third data signal identifies the tank of ink Bk and "control code" indicates turning off the light in regard to the tank of ink Bk, the LED 142 turns off in the tank of ink Bk only.

For performing the flashing control of LED, the control circuit 300 of the main body side identifies an ink tank and transmits the data signal including "control code" of each of lighting and turning off the light of the LED to the identified ink tank. A flashing cycle of the LED can be controlled by defining a cycle of transmitting a signal.

Figure 12:
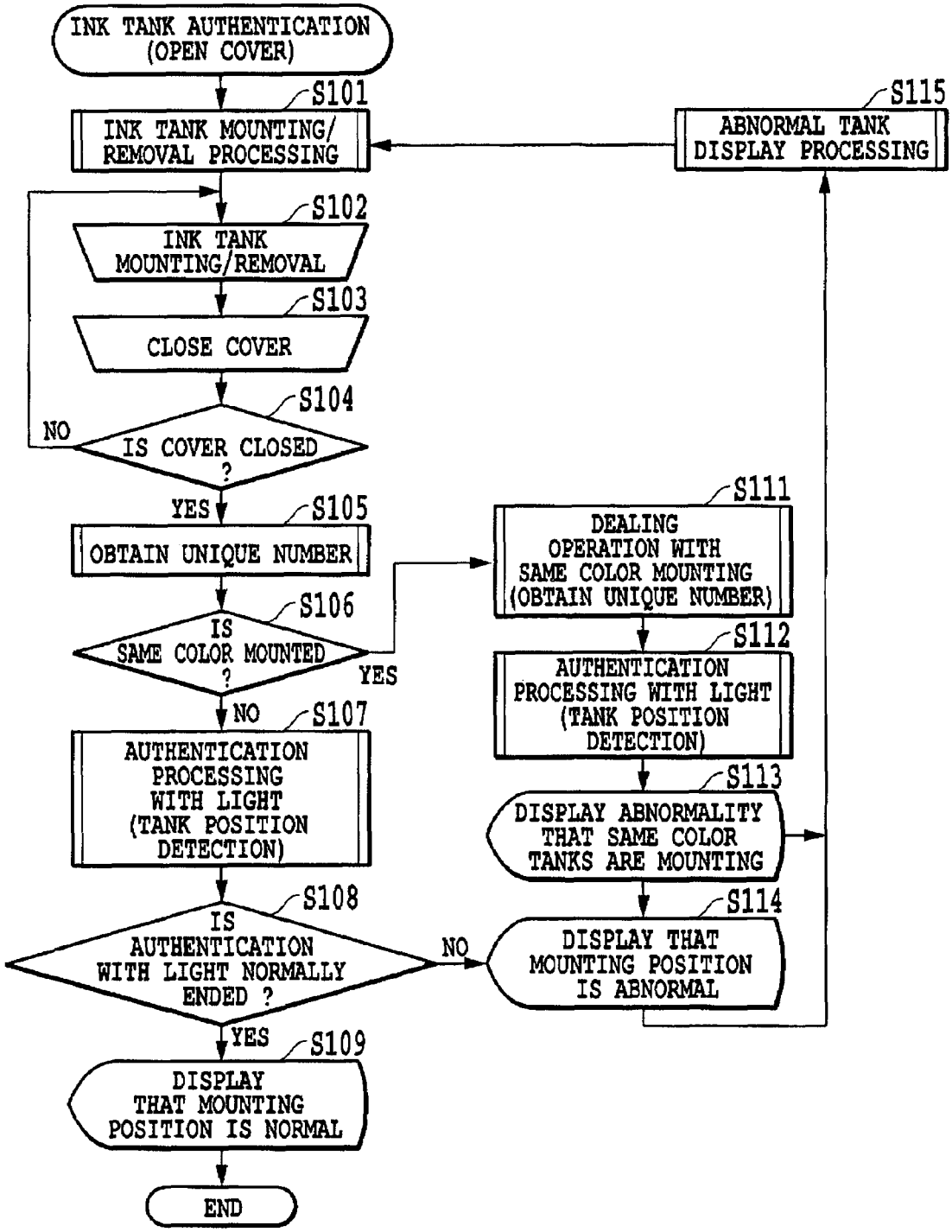
FIG. 12 is a flow chart showing the control procedure in mounting/removal of an ink tank.

FIG. 12 is a flow chart showing the control procedure relating to the mounting/removal of the ink tank based upon the structure of the embodiment. The processing shown in FIG. 12 is the processing, which is activated when a user opens the main body cover 201 of a printer and executed by the control circuit 300 of the main body side.

When the present processing is activated, first at step S101, the ink tank mounting/removal processing is executed. That is, when a certain sensor detects that the main body cover 201 of the printer is opened, the state information of each ink tank mounted at this time is obtained. This obtaining is made by transmitting the data signal of the packet structure from the main body to each ink tank control section. The state information obtained includes an ink remaining amount at this point and the unique number of the ink tank, which are read out from the memory array 403B. Obtaining the unique number is made by the same processing as the processing at step S105, and further at steps S106 and S111. In addition to the obtaining the state information, the carriage 196 is moved to an ink tank replacement position shown in FIG. 5 to finish the ink mounting/removal processing at step S101. This brings a condition where a user can freely perform removal of the ink tank 101.

At step S102, a user removes or mounts the ink tank 101. At step S103, a user closes the main body cover 201. At step S104, a certain sensor detects whether or not the main body cover 201 has closed. This processing continues to be executed until it is detected that the main body cover 201 has closed.

When the main body cover 201 is closed, at step S105 the processing for obtaining "unique numbers" of an ink tank newly mounted or of an ink tank which is already mounted is executed.

Figure 13:
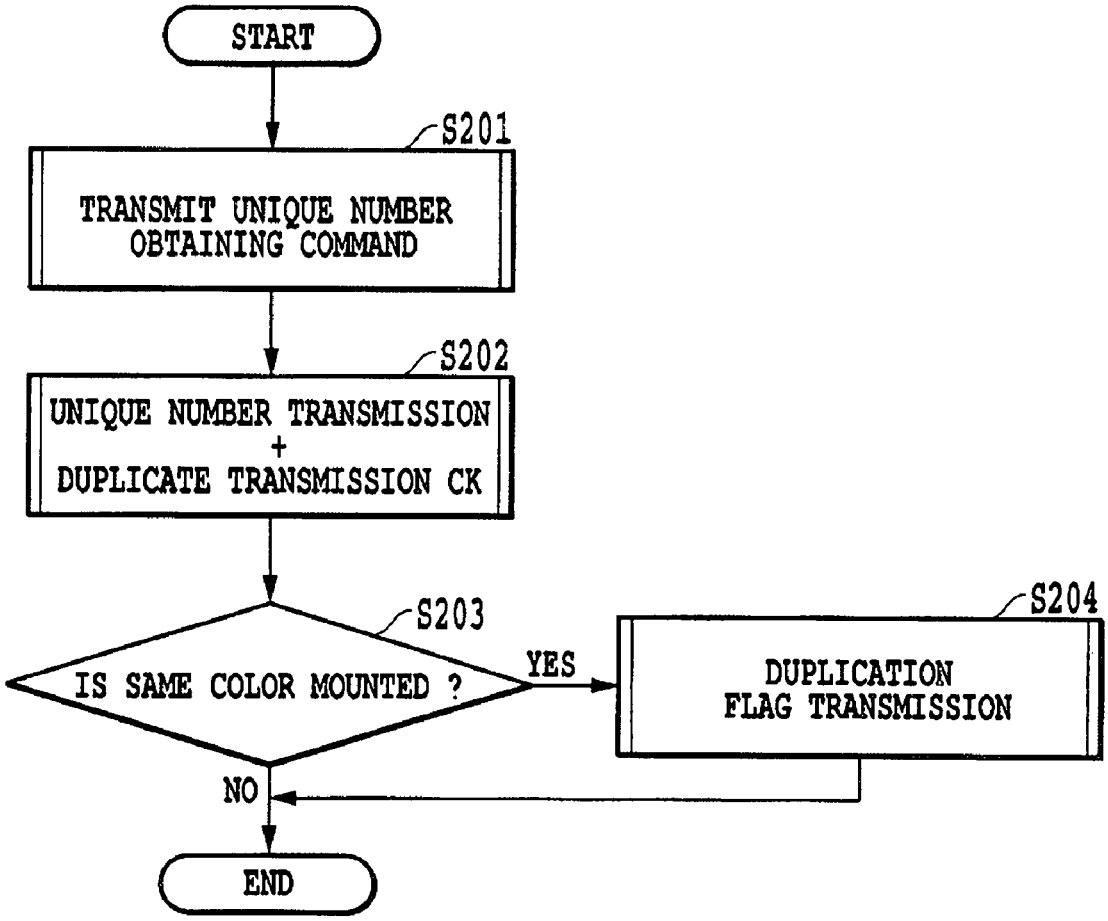
FIG. 13 is a flow chart showing the detail processing of step S105.

FIG. 13 is a flow chart showing a detail of the processing at step S105.

At step S201, the printer main body transmits a unique number obtaining command to the control section 144 of each ink tank 101.

Figure 14A:
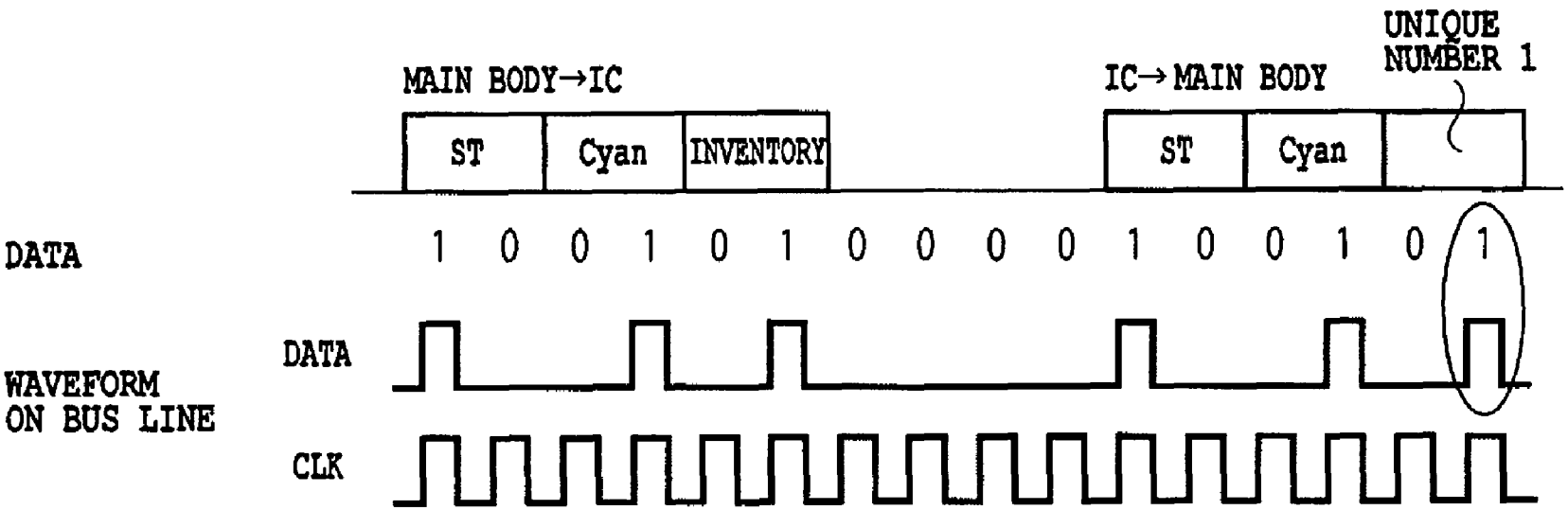
FIG. 14A is a data waveform in a case of singly transmitting a signal from an ink tank of a specific color.

The unique number obtaining command is transmitted so that each data signal of "start code+color information" and "control code" is, as shown in FIG. 14A, transmitted in synchronization with the clock signal CLK in this order. In a case where the control code is a code showing "Inventory", it means obtaining the unique number.

At step S202, the input/output control circuit 403A of the control section 144 transmits the unique number in response to the unique number obtaining command and it is checked whether or not the duplicate transmission by the tanks of the same color occurs in this transmission.

Figure 14B:
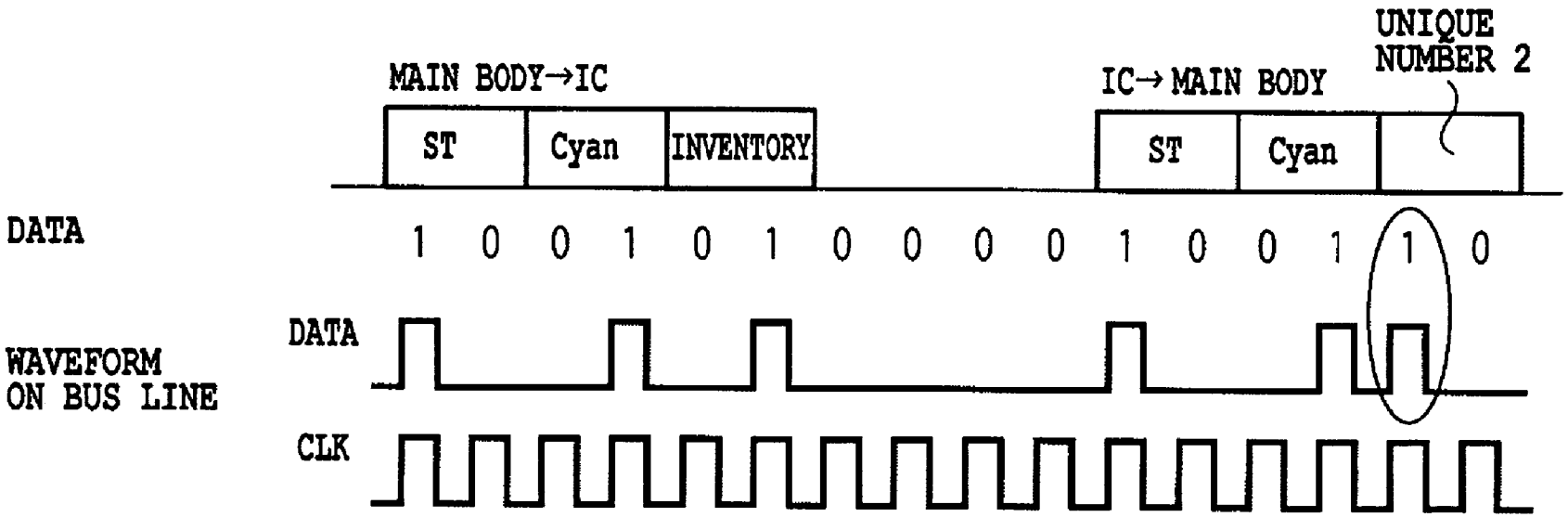
FIG. 14B is a data waveform in a case of singly transmitting a signal from an ink tank of a specific color different from an ink tank of the same color.
Figure 14C:
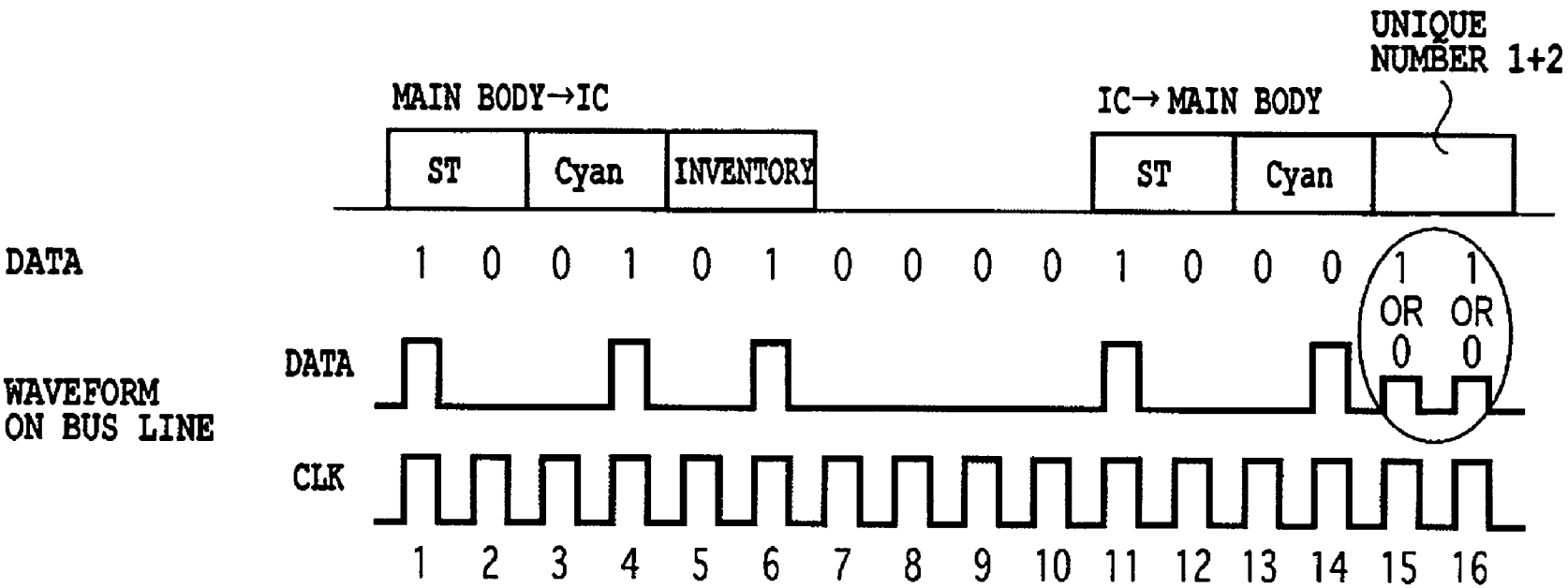
FIG. 14C is a data waveform in a case of transmitting overlapped signals from two ink tanks of a specific color.

Each ink tank, only when the "color information" of the ink tank itself corresponds to the color by the data signal, transmits the returning packet to the main body as shown in FIG. 14A. FIGS. 14A to 14C show a case of obtaining a unique number of an ink tank of cyan identified by "color information". In FIGS. 14A to 14C, only the input/output control circuit 403A of the ink tank of cyan transmits the returning packet. The returning packet is composed of each data signal of "start code (ST)+color information" and "unique number" and is transmitted to the main body in synchronization with the clock signal CLK.

I the case that a plurality of ink tanks of the same color are not mounted, the same color information identifying the ink tank does not exist. Therefore, a unique number can be obtained for each ink tank mounted. That is, the unique number is transmitted and also it is determined that the duplicate transmission by the tank of the same color is not made in the transmission.

Figure 15:
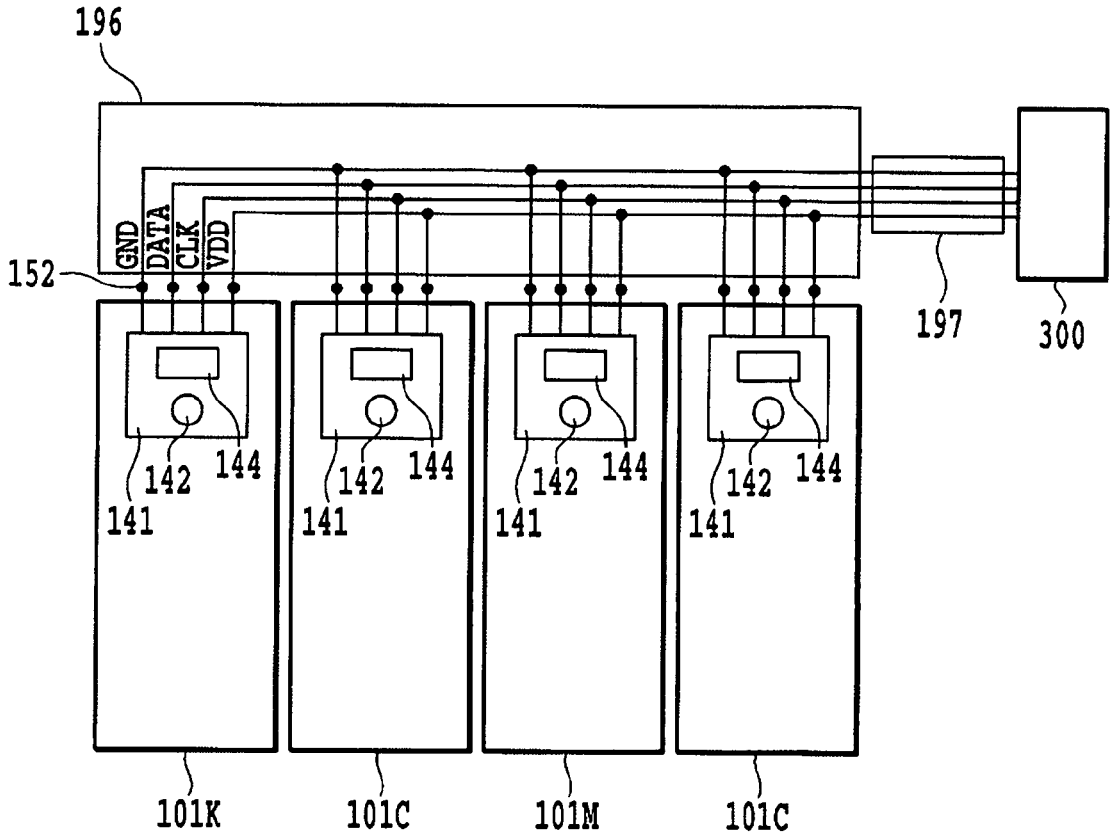
FIG. 15 is an explanatory diagram showing signal wiring in a flexible cable with tanks in a case where two ink tanks of cyan are mounted.

On the other hand, as shown in FIG. 15, when two ink tanks 101 of cyan are wrongly mounted at the same time, the two ink tanks of cyan can not be distinguished by "color information". That is, the two ink tanks 101C-a and 101C-b shown in FIG. 15 transmit the returning packets at the same time and it is determined that the duplicate transmission occurs.

Hereinafter, the determination processing as to whether or not the duplicate transmission occurs will be explained.

FIG. 14A shows a data waveform in a case where one ink tank 101C-a singly transmits the returning packet. FIG. 14B shows a data waveform in a case where the other ink tank 101C-b singly transmits the returning packet. These transmitted signals differ only in unique number. That is, a difference between the waveforms shown in FIG. 14A and FIG. 14B is in the waveform of the "DATA" portion of each of the fifteenth clock and the sixteenth clock. This portion is a portion transmitting "unique number" and one unique number is allotted to one ink tank 101. Therefore, the waveform of one ink tank must be different from that of the other even if the color of the ink is the same in both.

When the ink tanks of the same color 101C-a and 101C-b transmit the returning packets at the same time, the data waveform as shown in FIG. 14C is made. In the "DATA" portion, the waveform is made in accordance with the difference of the original waveforms.

Figures 16A, 16B, 16C:
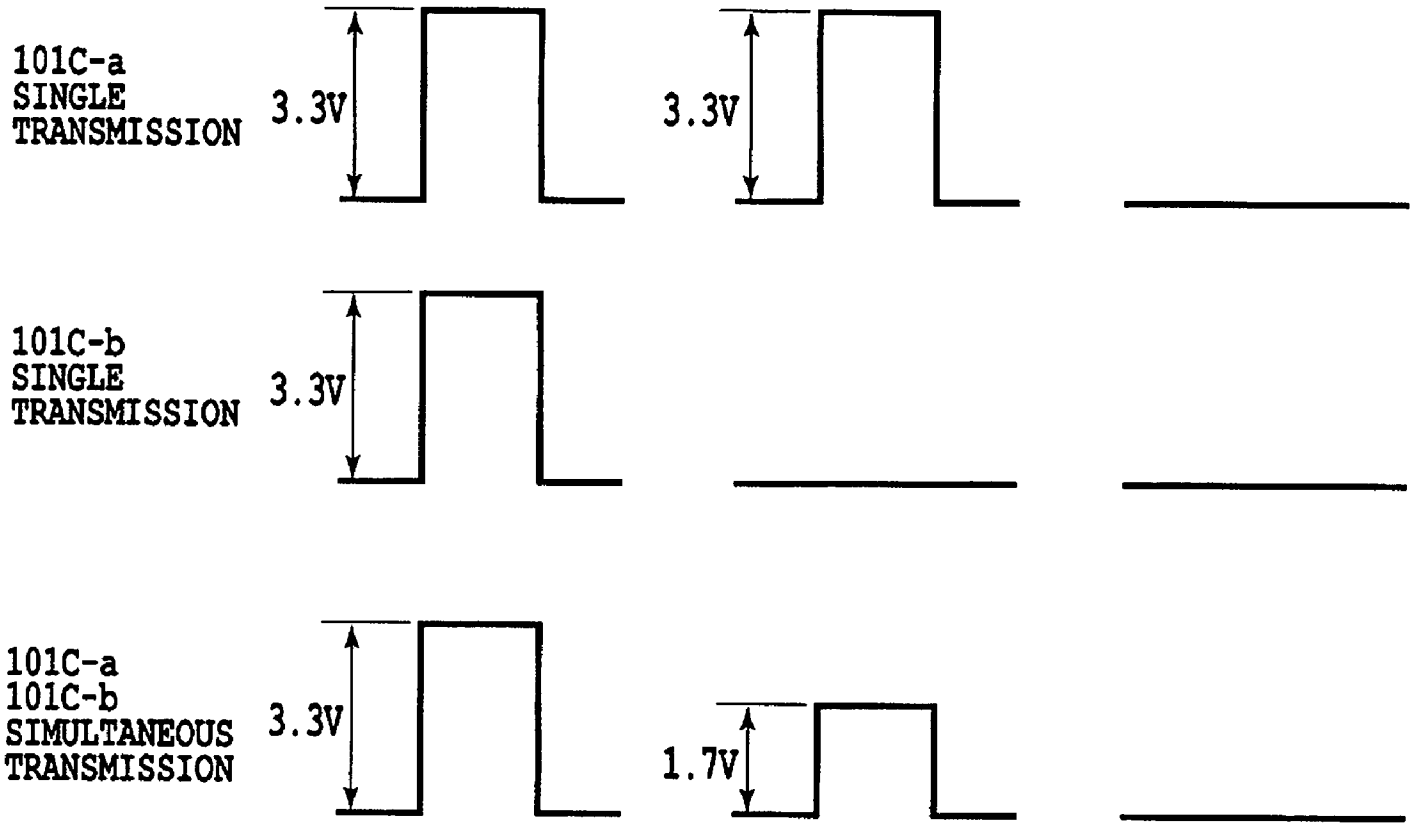
FIG. 16A is waveforms where two ink tanks of the same color respectively output a data waveform of "1" and the respective data waveforms are overlapped to form "1"
FIG. 16B is waveforms where two ink tanks of the same color respectively output data waveforms of "1" and "0" and the respective data waveforms are overlapped and FIG. 16C is waveforms where two ink tanks of the same color respectively output a data waveform of "0" and the respective data waveforms are overlapped to form "0"

FIG. 16A to FIG. 16C respectively show combinations of cases where the ink tanks 101C-a and 101C-b respectively output the waveform of "1" or "0". More specifically, FIG. 16A shows a case where the ink tanks 101C-a and 101C-b respectively output the waveform of "1". FIG. 16B shows a case where the ink tanks 101C-a and 101C-b respectively output the waveform of "1" and "0". FIG. 16C shows a case where the ink tanks 101C-a and 101C-b respectively output the waveform of "0" and "0". In each figure, the top stage shows the waveforms of the ink tank 101C-a and the middle stage shows the waveforms of the ink tank 101C-b. The bottom stage shows the waveforms in a case where the ink tanks 101C-a and 101C-b output the data waveforms at the same time to form the overlapped waveform. In the embodiment, the ink tank is adapted to output the waveform at a voltage of 3.3V. That is, when the data waveform is "1", the square waveform having a height of 3.3V is outputted.

As shown in FIG. 16A, the waveform data of the same "1" are outputted at the same time and are overlapped, the waveform of the same "1" is outputted. In addition, as shown in FIG. 16C, when the waveform data of the same "0" are overlapped, likewise the waveform of "0" is outputted.

The differential detector 403E of the input/output control circuit 403A detects a voltage difference. Specifically a voltage difference between the data waveform outputted from one ink tank itself and the data waveform made by overlapping of the data waveform by the one ink tank itself and the data waveform by the other ink tank is measured by using a comparator 403F of the differential detector 403E. The data waveform made by overlapping of the data waveform by the one ink tank itself and the data waveform by the other ink tank is a waveform appearing on the common signal line "DATA".

In a case shown in FIG. 16A, the differential detector 403E of the ink tank 101C-a detects 0V as the voltage difference between a voltage of 3.3V shown in the top stage and a voltage of 3.3V of the waveform overlapped shown in the bottom stage. Likewise, the ink tank 101C-b detects 0V as the voltage difference between a voltage of 3.3V shown in the middle stage and a voltage of 3.3V of the waveform overlapped shown in the bottom stage. That is, in a case of outputting the waveforms of the same "1" shown in FIG. 16A, the voltage difference is not measured.

A case where the ink tanks 101C-a and 101C-b both output "0" as shown in FIG. 16C is the same as the above case. That is, the differential detector 403E of the ink tank 101C-a detects 0V as the voltage difference between a voltage of 0V shown in the top stage and a voltage of 0V of the waveform overlapped shown in the bottom stage. Likewise, the ink tank 101C-b detects 0V as the voltage difference between a voltage of 0V shown in the middle stage and a voltage of 0V of the waveform overlapped shown in the bottom stage. That is, in a case of outputting the waveforms of the same "0", shown in FIG. 16C, the voltage difference is not measured.

In contrast, as shown in FIG. 16B, when the tanks of the same ink color output different waveforms, the differential detector 403E of each ink tank detects a voltage difference.

As shown in an example of FIG. 16B, when the ink tank 101C-a outputs "1", and the ink tank 101C-b outputs "0", the waveform made by the overlapping of these data waveforms, as shown in the bottom stage of the same figure, becomes a waveform having a height of 1.7V. The data of this waveform is unstable (not defined) and does not have information. At this point, the comparator 403F in the differential detector 403E of each of the ink tanks 101C-a and 101C-b detects a voltage difference between the data waveform outputted from the ink tank and the data waveform made by the overlapping of the data waveform outputted by the ink tank and the data waveform by another ink tank as follows.

In the ink tank 101C-a, a voltage difference of 1.6V between a voltage of 3.3V shown in the top stage of FIG. 16B and a voltage of 1.7V of the overlapped waveform shown in the bottom stage is detected. In addition, in the ink tank 101C-b, a voltage difference of 1.6V between a voltage of 0V shown in the middle stage and a voltage of 1.7V of the overlapped waveform shown in the bottom stage is detected.

In the aforementioned explanation, an example of two ink tanks of the same ink color is explained, but determination of the same color mounting based upon detection of the voltage difference is not limited to this example without mentioning. For example, in a case where three ink tanks of the same ink color are mounted, when the waveforms of these mutual data signals are different, these overlapped waveform is a waveform which is not "1" or "0". Accordingly, the voltage difference occurs between the overlapped waveform and the waveform of the data signal outputted from the each ink tank. In addition, by detecting occurrence of this voltage difference itself, it is possible to detect that the ink tank of the same ink color is mounted.

At step S203, when the input/output control circuit 403A of each of the ink tanks detects a voltage difference, it is determined that the transmission is overlapped, that is, the ink tanks of the same ink color are mounted.

In regard to "unique number", one individual number is allotted to one ink tank. When individual numbers are outputted at the same time, a combination in which the waveforms of "0" and "1" are overlapped is necessarily made. In a case where the waveforms of "0" and "1" are overlapped, a voltage difference between a voltage of the waveform outputted from the ink tank and a voltage of the overlapped waveform occurs without fail. By using this respect, it is possible to determine that the module outputted at the same time, that is, the ink tanks of the same color exist.

When it is determined that the ink tanks of the same color exist, at step S204 the ink tanks 101C-a and 101C-b of the same ink color respectively transmit a packet including a flag showing that the same color is duplicated. At this point, the ink tanks 101C-a and 101C-b respectively transmit the packet having the exactly same content, including the content of "DATA" including this flag. Accordingly, since the data signals having the same waveform with each other are to be transmitted to the printer main body, these data are not unstable. Here, when data signals having the same waveform are transmitted, it can be said that these data are definite (clear). When a data signal having a different waveform is transmitted, it can be said that these data are not indefinite (not clear).

Referring back to FIG. 12, the processing for obtaining a unique number at step S105 is executed. Then at step S106, as described above, it is determined whether or not an ink tank of the same color is mounted based upon a returning content of the ink tanks to which a unique number obtaining command has transmitted for obtaining a unique number. That is, when a packet including a stable unique number is transmitted from an ink tank, it is determined that the ink tank of the same color is not mounted. On the other hand, when a packet including a flag showing that the ink color is duplicated is transmitted from the ink tank, it is determined that the ink tanks of the same color are mounted. When it is determined that a plurality of ink tanks of the same color are mounted, based upon this determination, the determination content may be displayed in a main body operation section, instead of obtaining unique numbers for identifying individual ink tanks. Or in each LED of the plurality of the determined ink tanks, the determination content may be displayed.

As described above, in the individual ink tank, an output waveform of a data signal from one ink tank itself is compared with a waveform of a data signal inputted. When the comparison result is different from the original output waveform, it is determined that the other ink tank of the same color is mounted in overlap. In consequence, even when a plurality of ink tanks of the same color are mounted wrongly in the bus connection, they can be distinguished without using color information.

At step S106, it is determined that a plurality of ink tanks of the same color are mounted, the process goes to step S111, wherein a dealing operation with same color mounting is made for obtaining unique numbers from these ink tanks in a different way.

Figure 17:
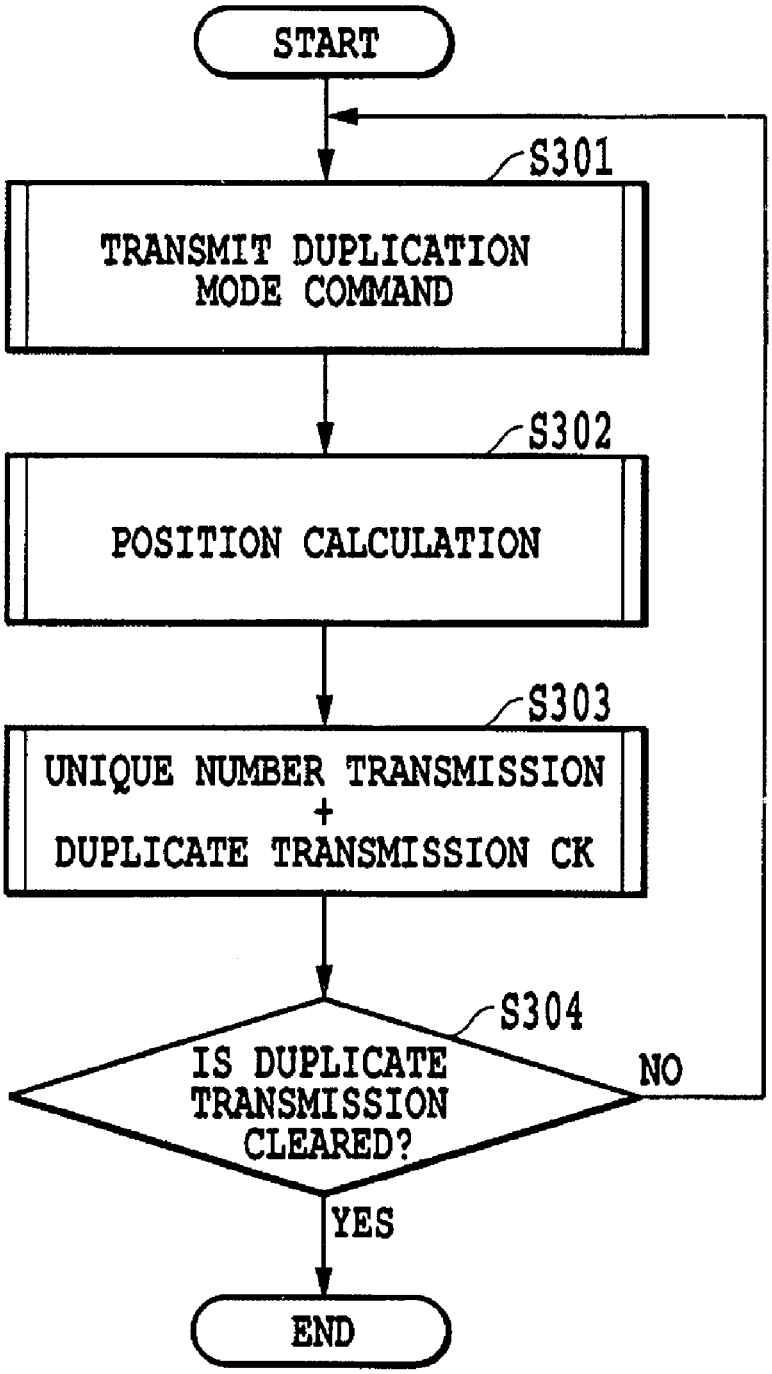
FIG. 17 is a flow chart showing the processing of obtaining unique numbers according to a first embodiment.

FIG. 17 is a flow chart showing a detail of the processing.

As described above, when an ink tank is identified by "color information" in the communication processing, in a case where a plurality of ink tanks of the same ink color are mounted, the ink tanks of the duplicated color can not be controlled individually. Therefore, the packet processing is made executed by "unique number". However, the packet processing for obtaining "unique number" is triggered by "color information". Since the ink tanks of the duplicated color return "unique number" at the same timing, "unique number" can not be obtained due to the interference. At step S111, the returns of "unique number" from the ink tanks of the duplicated color are made at different timings. An outline of this method is calculating timing of the return based upon "unique number". "Unique number" differs in each ink tank, therefore obtaining a different calculation result. In addition, transmission of "unique number" is made at the timing based upon this calculation result.

In FIG. 17, first at step S301, the control circuit 300 of the printer main body transmits a duplication mode command to each of ink tanks 101K, 101Y, 101M and 101C. This transmission packet is composed of each data signal of "start code (ST)+color information" and "position calculation data", which is transmitted in synchronization with a clock signal CLK.

At step S302, the ink tanks 101C-a and 101C-b denoted by the duplication mode command calculate the respective positions based upon the transmitted "position calculation data" and the respective "unique numbers".

Figure 18:
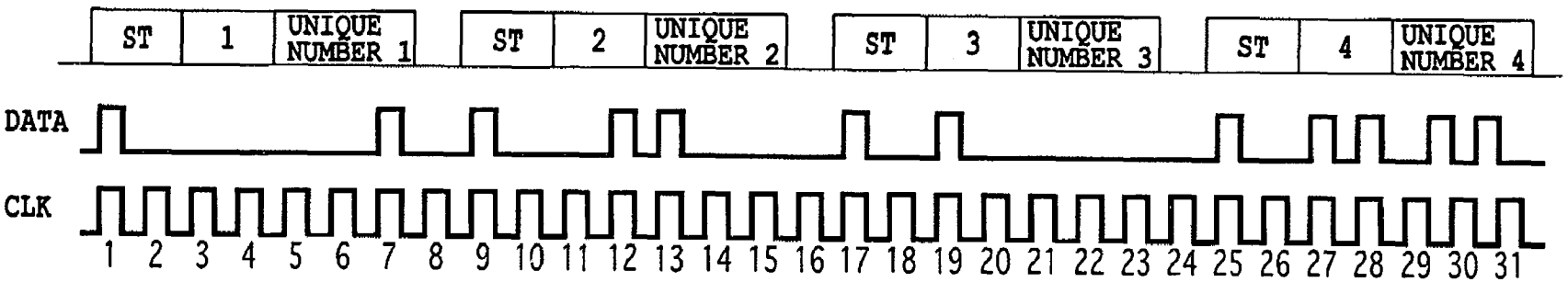
FIG. 18 is an explanatory diagram showing a position calculation in the unique number obtaining processing.

FIG. 18 is a diagram for explaining this position calculation. Here, "position" means timing for transmitting "unique number".

As shown in FIG. 18, four positions "1", "2", "3" and "4" are prepared. From clock 1 to clock 7 are in a range of position 1. Hereinafter, in order, from clock 9 to clock 15 are in a range of position 2, from clock 17 to clock 23 are in a range of position 3, and from clock 25 to clock 31 are in a range of position 4. In regard to data of "unique number", one unique number is allotted to one ink tank. Accordingly, the information amount corresponding to the number of all ink tanks to be manufactured should be retained in a memory. As compared to this, the number of positions only covers at least the number of ink tanks to be mounted in the printer (not necessarily the same number to that of the ink tanks). A compression calculation is made for obtaining the position based on the unique number. A general compression function can be used in the compression calculation. In the embodiment, MD4 as a general compression function is used to extract two lower bits of 128 bits as the calculation result, determining which one of the four positions the transmission timing is, based upon it. Since the calculation result is based upon "unique number", the possibility that it differs in each ink tank is high. This is because one unique number is allotted to one ink tank.

In the embodiment, further "position calculation data" is used, which is multiplied by "unique number" and compression calculation is made based upon the result. This is because in a case where the position calculation is made only by "unique number" included in each of the ink tanks of the duplicated color, when the calculation is repeated, the original data is the same as at the previous calculation time. In this case, since the calculation result is the same as the previous one, even if the processing is repeated many times, the confliction can not be solved. This "position calculation data" can be pseudorandom numbers generated in the control circuit 300 of the printer main body and is used in calculation for multiplication by "unique number".

At step S303, the ink tanks 101C-a and 101C-b of the duplicated color transmit the respective "unique numbers" at the respective positions (timing) according to the respective position calculation results. Along with the transmission, the determination processing on the duplicate transmission is executed similarly to the above described step S105.

At step S304, it is determined in the duplicate transmission determination processing that the duplicate transmission is solved, the present processing is ended. When the duplicate transmission still exists, a packet including a flag showing the duplicate transmission is transmitted to the main body. Since the position calculation is made by compression to two bits, i.e., four ways, the confliction (overlapping of the calculation result) may occur. After transmitting the packet including the duplication flag, the processes of step S301 and later are repeated in response to the command from the printer main body.

In this repetition processing, at step S301, a new different "position calculation data" is received from a printer. In addition, by multiplying the data by "unique number", the ink tanks 101C-a and 101C-b tend to have different positions.

By repeating the processing, even the ink tanks of the same color, the duplicate transmission can be solved to obtain "unique numbers". By the control based upon the unique number, even in the ink tanks of the same color, light-emitting of LED can be individually controlled and the writing/reading in the memory can be made. In view of this, the packet transmitted from the printer main body to the ink tanks has "color ID" which includes "color information" and "unique number".

By referring back to FIG. 12, when the unique number is obtained (S111) or it is determined that the tanks of the same color are not mounted (S106), the authentication processing with use of light is executed using the unique number obtained in each of step S112 or step S107.

The authentication processing with light is to determine whether or not normally mounted ink tanks are mounted in the respective correct positions. The printer of the embodiment has no structure or mechanism for define respective mounting positions in accordance with the ink tanks of respective colors. In consequence, there is the possibility that the ink tank of each color is wrongly mounted in a position different from a position it is supposed to be placed. Therefore, in a case where it is wrongly mounted, a user is informed of the wrong mounting through the authentication processing with light of the ink tank. An example of the wrong mounting includes a case where ink tanks of different colors are mounted in the adverse positions to each other. In addition, an ink tank of cyan C may be mounted in a position where an ink tank of yellow (Y) is to be mounted in a normal situation, and therefore, the ink tank of cyan may be doubly mounted. In such a case, a user can be informed of the wrong mounting by the authentication processing with use of light to be explained hereinafter.

FIG. 19A to FIG. 19D and FIG. 20A to FIG. 20D are diagrams for explaining the authentication processing with use of light.

Figure 19A:
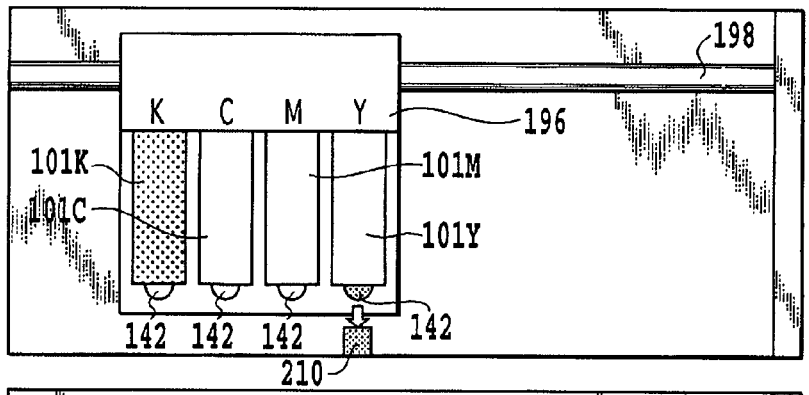
FIG. 19A is an explanatory diagram of authentication with light in a case where a yellow tank is mounted in a mounting position of yellow.

As shown in FIG. 19A, first, moving of the carriage 196 starts from the left side to the right side in the figure, relative to the first light receiving portion 210.

First, an ink tank mounted in a position where the ink tank 101Y of yellow ink is supposed to be mounted is controlled to cause the LED 142 to emit light at a position facing the first light receiving portion 210. This light-emitting turns off in a predetermined time after the lighting. In an example of FIG. 19A, the ink tank 101Y of a correct color is mounted. Likewise, the authentication processing with light is executed in regard to the other colors. When the carriage 196 is moved and a position where the ink tank is supposed to be mounted comes to a position facing the first light receiving portion 210, in a case where the ink tank 101Y is mounted in a correct position, the first light receiving portion 210 can receive light-emitting of the LED 142. The control circuit 300 determined that the ink tank 101Y is mounted in a correct mounting position.

Figure 19B:
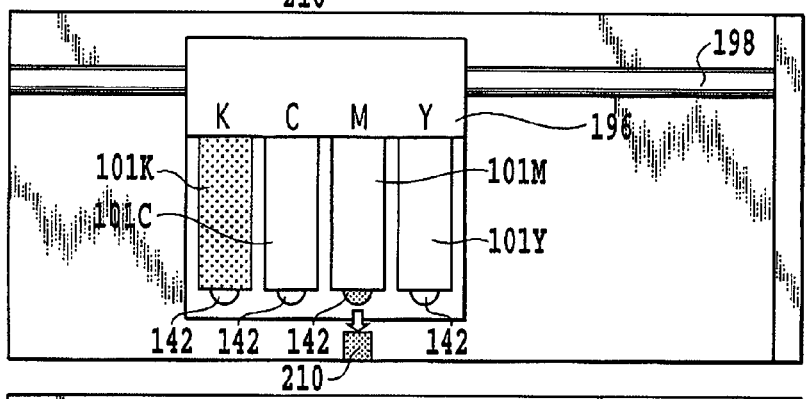
FIG. 19B is an explanatory diagram of authentication with light in a case where a magenta tank is mounted in a mounting position of magenta.

The carriage 196 is moved and a place where the ink tank 101M of magenta is supposed to be mounted is, as shown in FIG. 19B, moved to a position facing the first light receiving portion 210. Since in this position, the ink tank 101M actually mounted is a tank of magenta, the mounted color is correct and the LED 142 emits the light.

Figure 19C:
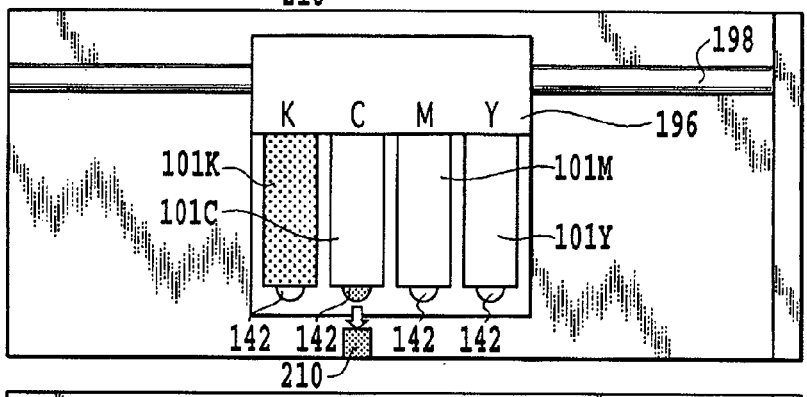
FIG. 19C is an explanatory diagram of authentication with light in a case where a cyan tank is mounted in a mounting position of cyan.
Figure 19D:
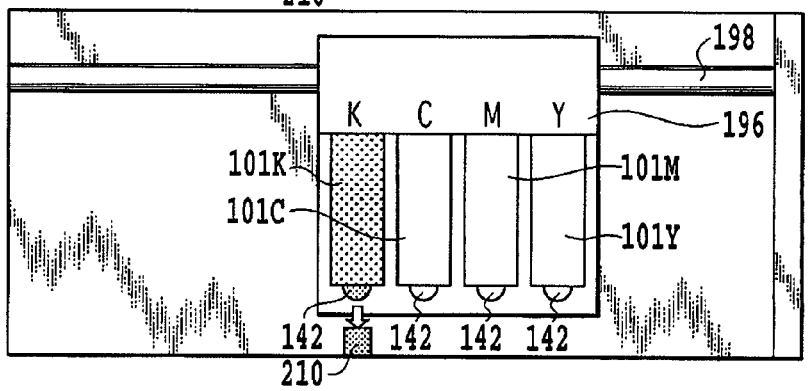
FIG. 19D is an explanatory diagram of authentication with light in a case where a K tank is mounted in a mounting position of K.

An example shown in this figure shows that the ink tank 101M is mounted in a correct position and therefore, the first light receiving portion 210 receives the light-emitting. In order, as shown in FIG. 19C to FIG. 19D, a mounting position to be determined is changing, while emitting light. These figures show examples where the tanks are mounted in respective correct positions.

Figure 20A:
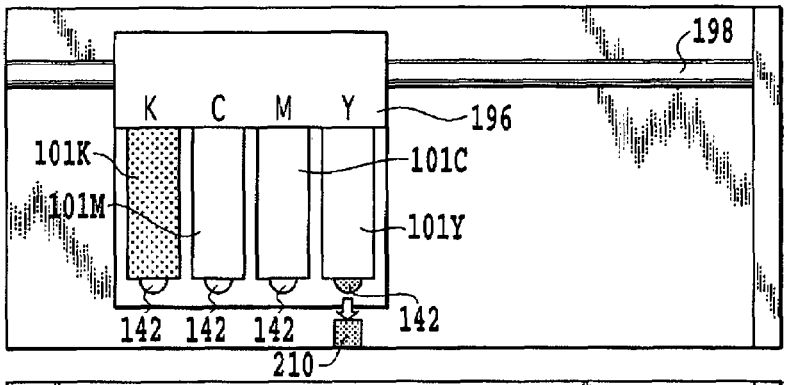
FIG. 20A is an explanatory diagram of authentication with light in a case where a yellow tank is mounted in a mounting position of yellow.
Figure 20B:
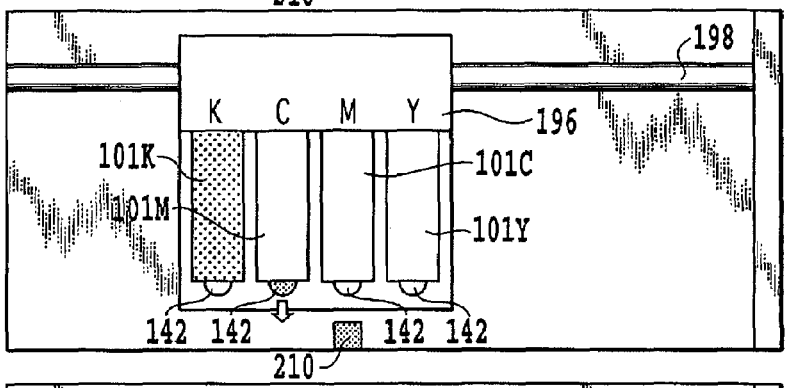
FIG. 20B is an explanatory diagram of authentication with light in a case where a cyan tank is mounted in a mounting position of magenta.

On the other hand, there is explained a case where the ink tank 101C of cyan ink is wrongly mounted in a position where the ink tank 101M of magenta ink is supposed to be mounted as shown in FIG. 20B. The LED 142 of the ink tank 101C facing the first light receiving portion 210 does not emit light since a color of an ink tank which should be mounted is different from a color of an ink tank actually mounted. At this point, the LED 142 of the ink tank 101M wrongly mounted in a different position emits light. The LED 142 of the ink tank 101M of magenta is not in a position facing the first light receiving portion 210. When the LED 142 of the ink tank 101M of magenta lights up at timing when the carriage 196 comes to a position in FIG. 20B, the first light receiving portion 210 can not receive light of the LED 142 since the LED 142 does not face the first light receiving portion 210 with each other. The control circuit 300 determines that the ink tank at present mounted in a position facing the first light receiving portion 210 is not the ink tank 101M of magenta which is supposed to be mounted therein and is an ink tank of a different color.

Figure 20C:
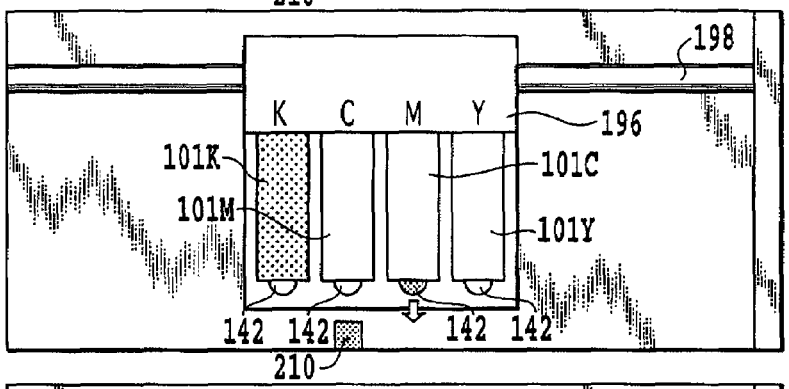
FIG. 20C is an explanatory diagram of authentication with light in a case where a magenta tank is mounted in a mounting position of cyan.
Figure 20D:
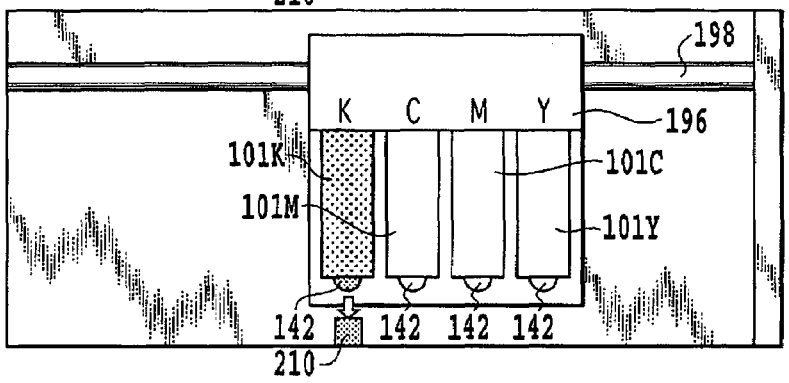
FIG. 20D is an explanatory diagram of authentication with light in a case where a K tank is mounted in a mounting position of K.

In FIG. 20C, the ink tank 101M of magenta is wrongly mounted in a position where the ink tank 101C of cyan is supposed to be mounted. Since the mounted tank is not a tank of a color which should be mounted in a normal situation, the LED 142 of the ink tank 101M facing the first light receiving portion 210 does not emit light. In addition, the LED 142 of the ink tank 101C of cyan mounted in another position emits light. If the ink tank 101C of cyan emits light, since it is not in a position facing the first light receiving portion 210, the first light receiving portion can not receive light of the LED.

The aforementioned explanation relates to a case where the ink tanks mounted on the carriage have all different colors with each other and the mounting position is incorrect.

Next, there is explained an example where a plurality of ink tanks of the same color are mounted on the carriage. That is, this example results in that an ink tank of a color which is not mounted exists.

As described in FIG. 15, the processing in a case where the ink tank of cyan is mounted in a position where the ink tank of yellow is supposed to be mounted and thus two ink tanks of cyan are mounted is as follows. The control circuit 300 of the printer main body detects by obtaining the unique numbers that two ink tanks of the same ink color are mounted. More specifically, the carriage is moved and, at a position where an ink tank of cyan is supposed to be mounted faces the first receiving portion, the LED of one ink tank of cyan identified by the unique number is caused to emit light. This is a case where the tank of a correct color mounted in a correct position emits light and the first light receiving portion can receive light from the LED. Next, at the same position of the carriage, the LED of other ink tank of cyan identified by the unique number is caused to emit light. At that time, a mounting place on a carriage where an ink tank of a wrong color is mounted is not a place facing the first light receiving portion, and thus the first light receiving portion can not receive light. Thereafter, the carriage is moved, and at a position where an ink tank of yellow is supposed to be mounted faces the first light receiving portion, a control is executed so that the LED of one ink tank of yellow identified by the unique number is caused to emit light. However, since the ink tank of cyan is mounted in this position at present, light emission by the ink tank of yellow does not exist and thus the first light receiving portion does not receive the light. In consequence, it can be detected that another ink tank is mounted in the position in which the ink tank of yellow is supposed to be mounted.

The control circuit 300 identifies the ink tank which is not mounted in a position where it is supposed to be mounted, by performing such authentication processing with use of light.

In addition, in a case where a correct ink tank is not mounted in a position where it should be mounted, herein the control circuit 300 performs control for making ink tanks of the other three colors emit light. This can identify what color the ink tank is composed of, which is wrongly mounted in that mounting position.

By referring back to FIG. 12, after the aforementioned authentication processing with light at step S107, it is determined at step S108 whether or not this processing is ended normally. When it is determined that the authentication with light is ended normally, at step S109 a display of an operation portion 195 is turned on in green to end the present processing.

On the other hand, when it is determined at step S108 that the authentication with light is not ended normally, or when the authentication processing with light at step S112 is ended, the display of the operation portion 195 is caused to flash, for example, in orange at step S114 or step S113. In addition, the abnormal tank display processing for flashing or turning on the LED 142 of the ink tank which is not mounted in an original, correct position is executed (step S115). In consequence, when a user opens the main body cover 192, the user can identify the ink tank which is not mounted in a correct position, resulting in promoting the ink tank to be remounted in a correct position.

Figure 21:
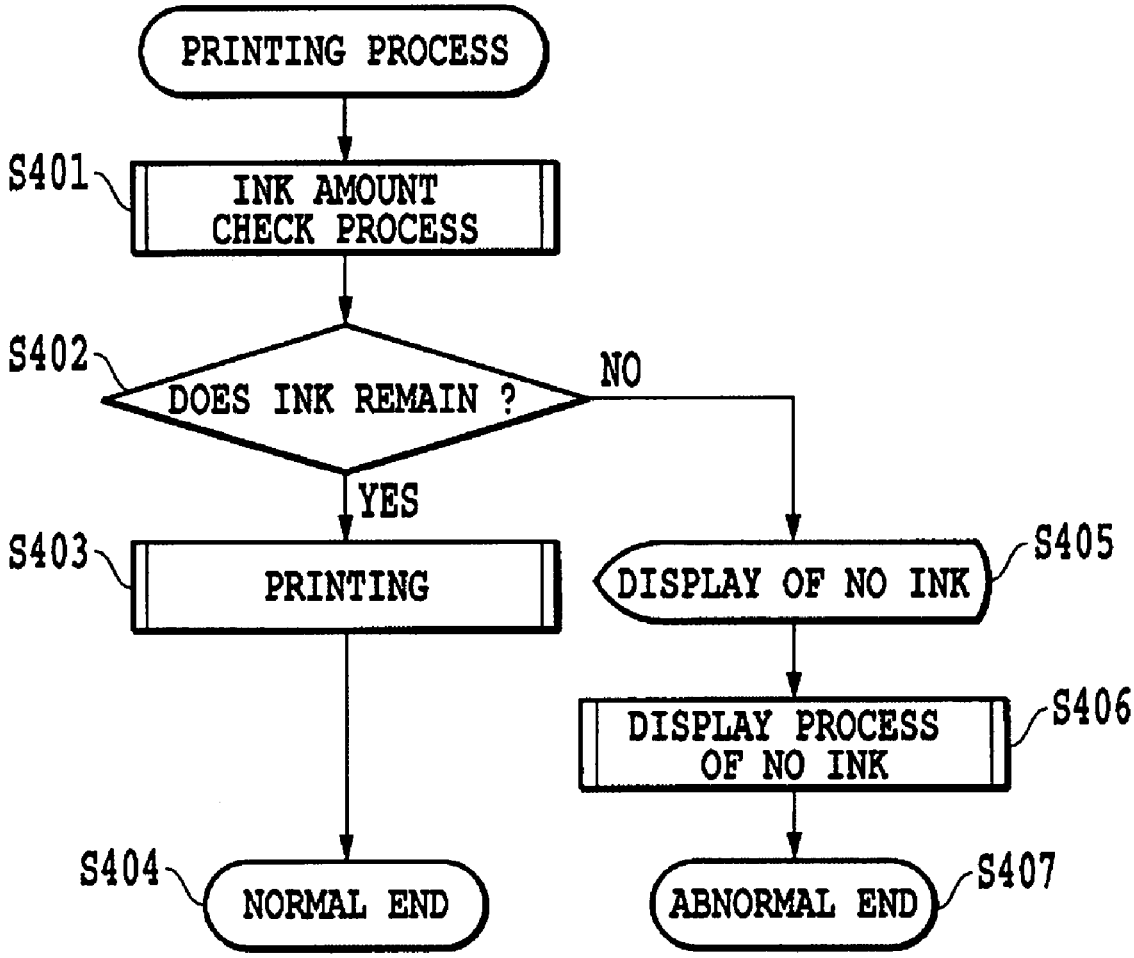
FIG. 21 is a flow chart showing the printing processing in a first embodiment.

FIG. 21 is a flow chart showing the printing processing according to the embodiment.

In the present processing, first at step S401, an ink remaining amount check processing is executed. This processing determines an ink amount required for printing the printed data in regard to a printing job to be printed. The required ink amount is determined by the calculation based upon a previously determined relation between the kind of the printed data and the ink amount, for example. The required ink amount is compared with the ink remaining amount of each ink tank to determine whether or not a sufficient amount of the ink required for printing the job remains. As the ink remaining amount, there can be used a value which is counted and determined as the remaining amount at that time in the control circuit 300.

At step S402, it is determined whether or not the ink remaining amount required for the printing remains. When the sufficient ink amount remains, at step S403 the printing operation is made and at step S404 the display of the operation portion 195 turns on in green to perform the normal end.

On the other hand, at step S402, when it is determined that the sufficient ink amount does not remain, at step S405 the display of the operation portion 195 flashes in orange. In addition, at step S406 the LED 142 of the ink tank 101 in which the ink remaining amount is small is caused to flash or turn on to perform the abnormal end.

It should be noted that in a case where the host PC for controlling the printing apparatus is connected, the ink remaining amount display may be made through a PC monitor at the same time.

The embodiment is so structured that the light guiding portion 121 is disposed in the ink tank and the display is made for a user by passing light through the display portion 122. However, a user may see a light-emitting element directly. In this case variations of light content due to the light guiding portion do not occur. Light content variations in light emitting of the light-emitting element itself serve as light content rank information of the light-emitting element.

OTHER EMBODIMENT

In the embodiment, the present invention is applied to an example of mounting ink tanks as liquid containers used in an ink jet printing apparatus. However, an application of the present invention is not limited to this example without mentioning. The present invention may be applied to a case where, in a system where a plurality of vessels for storing any liquid are provided and positions where the vessels are supposed to be mounted are determined, detection of the vessel by using bus connection or display control based upon it is perform. In this case, vessels relating to overlap mounting are not limited to vessels of the same color, but may be vessels of the same kind.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-182428, filed Jun. 30, 2006, which is hereby incorporated by reference herein in its entirety.

What is claimed is:

1. A liquid container that is provided with a container portion for storing a liquid and a control section capable of making a signal connection with a control circuit of a printing apparatus through a common signal line to said liquid container and other liquid container, said liquid container comprising:

detecting means for detecting a wave form C according to a difference between a wave form A of a signal outputted from the control section and passing through the common signal line and a wave form B of a signal inputted into the control section through the common signal line; and transmitting means for, when the wave form C detected by said detecting means differs from the wave form A of the outputted signal, transmitting information indicating that the wave forms differ from each other to the control circuit of the printing apparatus through the common signal line.

2. A liquid container as claimed in claim 1, wherein the wave form B is a data wave form that is formed with the wave form A and a wave form D of a signal outputted from a control section of other liquid container which connects with said liquid container through the common signal line.

3. A liquid container as claimed in claim 1, further comprising:

memory means for storing unique numbers of ink tanks;

calculation means for calculating a transmitting order of the unique number transmitted through the common signal line based on the unique number stored in said memory means, when a signal indicating a duplicate mode is received from the control circuit of the printing apparatus; and second transmitting means for transmitting the unique number to the control circuit of the printing apparatus in the order calculated by said calculating means.

4. A liquid container as claimed in claim 1, wherein said detecting means detects a voltage difference between a voltage of the outputted signal and a voltage of the inputted signal, as the wave form.

5. An ink jet printing apparatus in which a plurality of ink tanks are removably mounted and which performs printing by ejecting ink from a printing head, the ink being supplied from the mounted ink tanks to the printing head, said printing apparatus comprising:

a control circuit; and a common signal line the for making a signal connection between said control circuit and the plurality of ink tanks, said common signal line being common to the plurality of ink tanks, wherein when information indicating that a wave form C according to a difference between a wave form A of a signal outputted from control sections of the ink tanks and passing through the common signal line and a wave form B of a signal inputted into the control section through the common signal line differs from the wave form A of the outputted signal is transmitted to said control circuit through the common signal line, said control circuit executes a control in accordance with the received information.

6. An ink jet printing apparatus as claimed in claim 5, wherein said control circuit of said printing apparatus transmits a command for obtaining a unique number of the ink tank to the control section of that ink tank which has outputted the information indicating that the wave forms differ from each other and identifies the ink tank based on the unique number transmitted from the ink tank in response to the command, so that said control circuit executes the control for the identified ink tank.

* * * * *